US010867477B2

(12) United States Patent
Graham et al.

(10) Patent No.: US 10,867,477 B2
(45) Date of Patent: Dec. 15, 2020

(54) GAMING SYSTEM AND METHOD FOR PROVIDING DIFFERENT BONUS AWARDS BASED ON DIFFERENT TYPES OF TRIGGERED EVENTS

(71) Applicant: IGT, Las Vegas, NV (US)

(72) Inventors: Jacob Thomas Graham, Sparks, NV (US); Gregory A. Schlottmann, Sparks, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/970,362

(22) Filed: May 3, 2018

(65) Prior Publication Data

US 2018/0253941 A1 Sep. 6, 2018

Related U.S. Application Data

(60) Continuation of application No. 14/546,785, filed on Nov. 18, 2014, now Pat. No. 9,978,213, which is a division of application No. 11/837,151, filed on Aug. 10, 2007, now Pat. No. 8,900,053.

(51) Int. Cl.
*G07F 17/32* (2006.01)

(52) U.S. Cl.
CPC ..... *G07F 17/3258* (2013.01); *G07F 17/32* (2013.01)

(58) Field of Classification Search
None
See application file for complete search history.

(56) References Cited

U.S. PATENT DOCUMENTS

| | | | |
|---|---|---|---|
| 4,335,809 | A | 6/1982 | Wain |
| 4,572,509 | A | 2/1986 | Sitrick |
| 4,624,459 | A | 11/1986 | Kaufman |
| 4,648,600 | A | 3/1987 | Olliges |
| 4,652,998 | A | 3/1987 | Koza et al. |
| 4,695,053 | A | 9/1987 | Vazquez, Jr. et al. |
| 4,842,278 | A | 6/1989 | Markowicz |
| 4,856,787 | A | 8/1989 | Itkis |
| 4,866,515 | A | 9/1989 | Tagawa et al. |
| 4,924,378 | A | 5/1990 | Hershey et al. |
| 5,085,435 | A | 2/1992 | Rossides |
| 5,138,712 | A | 8/1992 | Corbin |
| 5,142,622 | A | 8/1992 | Owens |
| 5,178,390 | A | 1/1993 | Okada |
| 5,179,517 | A | 1/1993 | Sarbin et al. |

(Continued)

FOREIGN PATENT DOCUMENTS

| | | |
|---|---|---|
| EP | 0 843 272 | 5/1998 |
| EP | 0 945 837 | 3/1999 |

(Continued)

*Primary Examiner* — Seng H Lim
(74) *Attorney, Agent, or Firm* — Neal, Gerber & Eisenberg LLP

(57) ABSTRACT

A gaming system including a central server linked to a plurality of gaming devices. The central server tracks the occurrences of one or more suitable events occurring at or in association with one or more gaming devices in the gaming system. Upon the central server determining that the quantity of occurred events tracked has reached a designated quantity or threshold, (i.e., a triggering event has occurred), the gaming system provides a progressive award to one of the players at one of the gaming devices in the gaming system.

17 Claims, 10 Drawing Sheets

(56) References Cited

U.S. PATENT DOCUMENTS 5,265,874 A 11/1993 Dickinson et al.
5,276,312 A 1/1994 McCarthy
5,280,909 A 1/1994 Tracy
5,288,978 A 2/1994 Iijima
5,290,033 A 3/1994 Bittner et al.
5,305,195 A 4/1994 Murphy
5,326,104 A 7/1994 Pease et al.
5,342,047 A 8/1994 Heidel et al.
5,344,144 A 9/1994 Canon
5,349,642 A 9/1994 Kingdon
5,375,206 A 12/1994 Hunter et al.
5,377,993 A 1/1995 Josephs
5,404,567 A 4/1995 DePietro et al.
5,429,361 A 7/1995 Raven et al.
5,430,791 A 7/1995 Feit et al.
5,438,508 A 8/1995 Wyman
5,449,173 A 9/1995 Thomas et al.
5,470,079 A 11/1995 LeStrange et al.
5,472,196 A 12/1995 Rusnak
5,499,340 A 3/1996 Barritz
5,507,491 A 4/1996 Gatto et al.
5,511,781 A 4/1996 Wood et al.
5,530,232 A 6/1996 Taylor
5,542,669 A 8/1996 Charron et al.
5,559,313 A 9/1996 Claus et al.
5,560,603 A 10/1996 Seelig et al.
5,564,700 A 10/1996 Celona
5,566,337 A 10/1996 Szymanski et al.
5,578,808 A 11/1996 Taylor
5,580,311 A 12/1996 Haste, III
5,586,257 A 12/1996 Perlman
5,586,937 A 12/1996 Menashe
5,617,331 A 4/1997 Wakai et al.
5,620,182 A 4/1997 Rossides
5,626,341 A 5/1997 Jones et al.
5,630,757 A 5/1997 Gagin et al.
5,640,192 A 6/1997 Garfinkle
5,643,086 A 7/1997 Alcorn et al.
5,649,118 A 7/1997 Carlisle et al.
5,655,603 A 8/1997 Schulte et al.
5,655,961 A 8/1997 Acres et al.
5,664,998 A 9/1997 Seelig et al.
5,671,412 A 9/1997 Christiano
5,702,304 A 12/1997 Acres et al.
5,708,709 A 1/1998 Rose
5,717,604 A 2/1998 Wiggins
5,741,183 A 4/1998 Acres et al.
5,745,879 A 4/1998 Wyman
5,749,784 A 5/1998 Clapper, Jr.
5,752,882 A 5/1998 Acres et al.
5,755,621 A 5/1998 Marks et al.
5,758,069 A 5/1998 Olsen
5,759,102 A 6/1998 Pease et al.
5,762,552 A 6/1998 Vuong et al.
5,766,076 A 6/1998 Pease et al.
5,768,382 A 6/1998 Schneier et al.
5,779,545 A 7/1998 Berg et al.
5,779,549 A 7/1998 Walker et al.
5,800,268 A 9/1998 Molnick
5,800,269 A 9/1998 Holch et al.
5,806,855 A 9/1998 Cherry
5,816,918 A 10/1998 Kelly et al.
5,820,459 A 10/1998 Acres et al.
5,828,840 A 10/1998 Cowan et al.
5,833,538 A 11/1998 Weiss
5,833,540 A 11/1998 Miodunski et al.
5,836,817 A 11/1998 Acres et al.
5,845,283 A 12/1998 Williams et al.
5,848,932 A 12/1998 Adams
5,851,011 A 12/1998 Lott
5,851,149 A 12/1998 Xidos et al.
5,855,515 A 1/1999 Pease et al.
5,871,398 A 2/1999 Schneier et al.
5,876,284 A 3/1999 Acres et al.
5,882,261 A 3/1999 Adams
5,885,158 A 3/1999 Torango et al.
5,903,732 A 5/1999 Reed et al.
5,905,248 A 5/1999 Russell et al.
5,913,164 A 6/1999 Pawa et al.
5,917,725 A 6/1999 Thacher et al.
5,918,039 A 6/1999 Buswell et al.
5,925,127 A 7/1999 Ahmad
5,941,773 A 8/1999 Harlick
5,947,820 A 9/1999 Morro et al.
5,947,822 A 9/1999 Weiss
5,951,611 A 9/1999 La Pierre
5,971,271 A 10/1999 Wynn et al.
5,971,849 A 10/1999 Falciglia
5,974,409 A 10/1999 Sanu et al.
5,980,093 A 11/1999 Jones et al.
5,980,384 A 11/1999 Barrie
5,983,190 A 11/1999 Trower, II et al.
5,991,760 A 11/1999 Gauvin et al.
5,991,790 A 11/1999 Shah et al.
5,996,068 A 11/1999 Dwyer, III et al.
5,997,400 A 12/1999 Seelig et al.
5,997,401 A 12/1999 Crawford
5,999,808 A 12/1999 La Due
6,001,016 A 12/1999 Walker et al.
6,003,066 A 12/1999 Ryan et al.
6,003,094 A 12/1999 Dean
6,003,123 A 12/1999 Carter et al.
6,004,207 A 12/1999 Wilson, Jr. et al.
6,011,850 A 1/2000 Bertrand et al.
6,012,832 A 1/2000 Saunders et al.
6,012,982 A 1/2000 Piechowiak et al.
6,015,344 A 1/2000 Kelly et al.
6,024,640 A 2/2000 Walker et al.
6,033,307 A 3/2000 Vancura
6,048,269 A 4/2000 Burns et al.
6,056,289 A 5/2000 Clapper, Jr.
6,059,289 A 5/2000 Vancura
6,068,552 A 5/2000 Walker et al.
6,068,982 A 5/2000 Rolfe et al.
6,071,190 A 6/2000 Weiss et al.
6,085,247 A 7/2000 Parsons, Jr. et al.
6,089,975 A 7/2000 Dunn
6,089,977 A 7/2000 Bennett
6,089,982 A 7/2000 Holch et al.
6,099,408 A 8/2000 Schneier et al.
6,106,396 A 8/2000 Alcorn et al.
6,108,420 A 8/2000 Larose et al.
6,110,041 A 8/2000 Walker et al.
6,113,098 A 9/2000 Adams
6,113,495 A 9/2000 Walker et al.
6,117,013 A 9/2000 Eiba
6,126,542 A 10/2000 Fier
6,135,884 A 10/2000 Hedrick et al.
6,135,887 A 10/2000 Pease et al.
6,141,737 A 10/2000 Krantz et al.
6,142,872 A 11/2000 Walker et al.
6,149,522 A 11/2000 Alcorn et al.
6,151,707 A 11/2000 Hecksel et al.
6,159,098 A 12/2000 Slomiany et al.
6,162,121 A 12/2000 Morro et al.
6,162,122 A 12/2000 Acres et al.
6,168,523 B1 1/2001 Piechowiak et al.
6,190,255 B1 2/2001 Thomas et al.
6,203,430 B1 3/2001 Walker et al.
6,206,782 B1 3/2001 Walker et al.
6,217,448 B1 4/2001 Olsen
6,219,836 B1 4/2001 Wells et al.
6,224,486 B1 5/2001 Walker et al.
6,231,445 B1 5/2001 Acres
6,234,900 B1 5/2001 Cumbers
6,241,608 B1 6/2001 Torango
6,244,958 B1 6/2001 Acres
6,251,014 B1 6/2001 Stockdale et al.
6,254,483 B1 7/2001 Acres
6,257,981 B1 7/2001 Acres et al.
6,264,561 B1 7/2001 Saffari et al.
6,267,671 B1 7/2001 Hogan
6,270,409 B1 8/2001 Shuster
6,287,200 B1 9/2001 Sharma

(56) References Cited

U.S. PATENT DOCUMENTS

| | | | |
|---|---|---|---|
| 6,287,202 | B1 | 9/2001 | Pascal et al. |
| 6,293,866 | B1 | 9/2001 | Walker et al. |
| 6,302,793 | B1 | 10/2001 | Fertitta, III et al. |
| 6,304,905 | B1 | 10/2001 | Clark |
| 6,308,271 | B2 | 10/2001 | Tanaka |
| 6,311,978 | B1 | 11/2001 | Yoseloff et al. |
| 6,312,332 | B1 | 11/2001 | Walker et al. |
| 6,312,333 | B1 | 11/2001 | Acres |
| 6,319,122 | B1 | 11/2001 | Packes, Jr. et al. |
| 6,319,125 | B1 | 11/2001 | Acres |
| 6,322,309 | B1 | 11/2001 | Thomas et al. |
| 6,328,649 | B1 | 12/2001 | Randall et al. |
| 6,345,386 | B1 | 2/2002 | Delo et al. |
| 6,353,928 | B1 | 3/2002 | Altberg et al. |
| 6,354,946 | B1 | 3/2002 | Finn |
| 6,358,150 | B1 | 3/2002 | Mir et al. |
| 6,361,437 | B1 | 3/2002 | Walker et al. |
| 6,361,441 | B1 | 3/2002 | Walker et al. |
| 6,364,314 | B1 | 4/2002 | Canterbury |
| 6,364,768 | B1 | 4/2002 | Acres et al. |
| 6,368,216 | B1 | 4/2002 | Hedrick et al. |
| 6,371,852 | B1 | 4/2002 | Acres |
| 6,375,567 | B1 | 4/2002 | Acres |
| 6,375,569 | B1 | 4/2002 | Acres |
| 6,383,074 | B1 | 5/2002 | Boggs |
| 6,389,538 | B1 | 5/2002 | Gruse et al. |
| 6,389,589 | B1 | 5/2002 | Mishra et al. |
| 6,394,907 | B1 | 5/2002 | Rowe |
| 6,397,381 | B1 | 5/2002 | Delo et al. |
| 6,398,218 | B1 | 6/2002 | Vancura |
| 6,398,643 | B1 | 6/2002 | Knowles et al. |
| 6,402,614 | B1 | 6/2002 | Schneier et al. |
| 6,409,602 | B1 | 6/2002 | Wiltshire et al. |
| 6,418,554 | B1 | 7/2002 | Delo et al. |
| 6,425,828 | B2 | 7/2002 | Walker et al. |
| 6,427,227 | B1 | 7/2002 | Chamberlain |
| 6,431,983 | B2 | 8/2002 | Acres |
| 6,439,996 | B2 | 8/2002 | LeMay et al. |
| 6,442,529 | B1 | 8/2002 | Krishan et al. |
| 6,443,452 | B1 | 9/2002 | Brune |
| 6,443,839 | B2 | 9/2002 | Stockdale et al. |
| 6,450,887 | B1 | 9/2002 | Mir et al. |
| 6,457,175 | B1 | 9/2002 | Lerche |
| 6,488,585 | B1 | 12/2002 | Wells et al. |
| 6,503,146 | B2 | 1/2003 | Walker et al. |
| 6,506,118 | B1 | 1/2003 | Baerlocher et al. |
| 6,508,710 | B1 | 1/2003 | Paravia et al. |
| 6,523,166 | B1 | 2/2003 | Mishra et al. |
| 6,527,638 | B1 | 3/2003 | Walker et al. |
| 6,532,543 | B1 | 3/2003 | Smith et al. |
| 6,533,273 | B2 | 3/2003 | Cole et al. |
| 6,533,664 | B1 | 3/2003 | Crumby |
| 6,558,255 | B2 | 5/2003 | Walker et al. |
| 6,565,091 | B2 | 5/2003 | Weingardt |
| 6,565,434 | B1 | 5/2003 | Acres |
| 6,575,832 | B1 | 6/2003 | Manfredi et al. |
| 6,578,199 | B1 | 6/2003 | Tsou et al. |
| 6,592,457 | B1 | 7/2003 | Frohm et al. |
| 6,595,856 | B1 | 7/2003 | Ginsburg et al. |
| 6,607,438 | B2 | 8/2003 | Baerlocher et al. |
| 6,607,439 | B2 | 8/2003 | Schneier et al. |
| 6,609,971 | B2 | 8/2003 | Vancura |
| 6,609,973 | B1 | 8/2003 | Weiss |
| 6,609,978 | B1 | 8/2003 | Paulsen |
| 6,612,574 | B1 | 9/2003 | Cole et al. |
| 6,612,575 | B1 | 9/2003 | Cole et al. |
| 6,620,047 | B1 | 9/2003 | Alcorn et al. |
| 6,628,939 | B2 | 9/2003 | Paulsen |
| 6,638,170 | B1 | 10/2003 | Crumby |
| 6,645,077 | B2 | 11/2003 | Rowe |
| 6,656,048 | B2 | 12/2003 | Olsen |
| 6,682,423 | B2 | 1/2004 | Brosnan et al. |
| 6,685,567 | B2 | 2/2004 | Cockerille et al. |
| 6,692,355 | B2 | 2/2004 | Baerlocher et al. |
| 6,699,124 | B2 | 3/2004 | Suchocki |
| 6,712,697 | B2 | 3/2004 | Acres |
| 6,712,699 | B2 | 3/2004 | Walker et al. |
| 6,712,702 | B2 | 3/2004 | Goldberg et al. |
| 6,722,985 | B2 | 4/2004 | Criss-Puszkiewicz et al. |
| 6,722,986 | B1 | 4/2004 | Lyons et al. |
| 6,726,563 | B1 | 4/2004 | Baerlocher et al. |
| 6,729,956 | B2 | 5/2004 | Wolf et al. |
| 6,729,957 | B2 | 5/2004 | Burns et al. |
| 6,729,958 | B2 | 5/2004 | Burns et al. |
| 6,733,389 | B2 | 5/2004 | Webb et al. |
| 6,733,390 | B2 | 5/2004 | Walker et al. |
| 6,736,725 | B2 | 5/2004 | Burns et al. |
| 6,739,973 | B1 | 5/2004 | Lucchesi et al. |
| 6,746,327 | B2 | 6/2004 | Frohm et al. |
| 6,749,510 | B2 | 6/2004 | Giobbi |
| 6,755,742 | B1 | 6/2004 | Hartman et al. |
| 6,782,477 | B2 | 8/2004 | McCarroll |
| 6,790,142 | B2 | 9/2004 | Okada et al. |
| 6,790,143 | B2 | 9/2004 | Crumby |
| 6,793,578 | B2 | 9/2004 | Luccesi et al. |
| 6,800,030 | B2 | 10/2004 | Acres |
| 6,802,778 | B1 | 10/2004 | LeMay et al. |
| 6,804,763 | B1 | 10/2004 | Stockdale et al. |
| 6,805,634 | B1 | 10/2004 | Wells et al. |
| 6,811,488 | B2 | 11/2004 | Paravia et al. |
| 6,813,765 | B1 | 11/2004 | Flores |
| 6,816,882 | B1 | 11/2004 | Conner et al. |
| 6,823,456 | B1 | 11/2004 | Dan et al. |
| 6,830,515 | B2 | 12/2004 | Rowe |
| 6,832,958 | B2 | 12/2004 | Acres et al. |
| 6,834,245 | B2 | 12/2004 | Ota et al. |
| 6,836,794 | B1 | 12/2004 | Lucovsky et al. |
| 6,843,723 | B2 | 1/2005 | Joshi |
| 6,843,725 | B2 | 1/2005 | Nelson |
| 6,846,238 | B2 | 1/2005 | Wells |
| 6,848,995 | B1 | 2/2005 | Walker et al. |
| 6,852,031 | B1 | 2/2005 | Rowe |
| 6,855,054 | B2 | 2/2005 | White et al. |
| 6,855,057 | B2 | 2/2005 | Namba et al. |
| 6,857,959 | B1 | 2/2005 | Nguyen |
| 6,863,608 | B1 | 3/2005 | LeMay et al. |
| 6,866,581 | B2 | 3/2005 | Martinek et al. |
| 6,866,584 | B2 | 3/2005 | Michaelson |
| 6,866,586 | B2 | 3/2005 | Oberberger et al. |
| 6,869,360 | B2 | 3/2005 | Marks et al. |
| 6,875,109 | B2 | 4/2005 | Stockdale |
| 6,875,110 | B1 | 4/2005 | Crumby |
| 6,878,063 | B2 | 4/2005 | Manfredi et al. |
| 6,884,162 | B2 | 4/2005 | Raverdy et al. |
| 6,884,166 | B2 | 4/2005 | Leen et al. |
| 6,884,170 | B2 | 4/2005 | Rowe |
| 6,884,171 | B2 | 4/2005 | Eck et al. |
| 6,884,173 | B2 | 4/2005 | Gauselmann |
| 6,884,174 | B2 | 4/2005 | Lundy et al. |
| 6,887,151 | B2 | 5/2005 | Leen et al. |
| 6,887,154 | B1 | 5/2005 | Luciano et al. |
| 6,887,156 | B2 | 5/2005 | DeWeese et al. |
| 6,889,159 | B2 | 5/2005 | Klotz et al. |
| 6,890,256 | B2 | 5/2005 | Walker et al. |
| 6,892,182 | B1 | 5/2005 | Rowe et al. |
| 6,896,616 | B2 | 5/2005 | Weiss |
| 6,896,618 | B2 | 5/2005 | Benoy et al. |
| 6,899,627 | B2 | 5/2005 | Lam et al. |
| 6,899,628 | B2 | 5/2005 | Leen et al. |
| 6,901,375 | B2 | 5/2005 | Fernandez |
| 6,902,481 | B2 | 6/2005 | Breckner et al. |
| 6,905,411 | B2 | 6/2005 | Nguyen et al. |
| 6,908,391 | B2 | 6/2005 | Gatto et al. |
| 6,910,964 | B2 | 6/2005 | Acres |
| 6,910,965 | B2 | 6/2005 | Downes |
| 6,923,721 | B2 | 8/2005 | Luciano et al. |
| 6,939,234 | B2 | 9/2005 | Beatty |
| 6,942,571 | B1 | 9/2005 | McAllister et al. |
| 6,945,870 | B2 | 9/2005 | Gatto et al. |
| 6,955,600 | B2 | 10/2005 | Glavich et al. |
| 6,969,319 | B2 | 11/2005 | Rowe et al. |
| 6,981,917 | B2 | 1/2006 | Webb et al. |
| 6,991,544 | B2 | 1/2006 | Soltys et al. |
| 6,997,807 | B2 | 2/2006 | Weiss |

(56) References Cited

U.S. PATENT DOCUMENTS 7,008,321 B2 3/2006 Rowe et al.
7,011,581 B2 3/2006 Cole et al.
7,025,674 B2 4/2006 Adams et al.
7,051,004 B2 5/2006 Nuttall et al.
7,056,215 B1 6/2006 Olive
7,063,617 B2 6/2006 Brosnan et al.
7,066,814 B2 6/2006 Glavich et al.
7,070,501 B2 7/2006 Cormack et al.
7,094,149 B2 8/2006 Walker et al.
7,121,942 B2 10/2006 Baerlocher
7,169,046 B2 1/2007 Webb et al.
7,223,172 B2 5/2007 Baerlocher et al.
7,740,534 B2 6/2010 Walker et al.
8,070,597 B2 12/2011 Cuddy
8,206,209 B1 6/2012 Fox
9,028,329 B2 5/2015 Graham
2001/0036857 A1 11/2001 Mothwurf et al.
2001/0044337 A1 11/2001 Rowe et al.
2001/0046893 A1 11/2001 Giobbi et al.
2001/0055990 A1 12/2001 Acres
2002/0032049 A1 3/2002 Walker et al.
2002/0034977 A1 3/2002 Burns et al.
2002/0042296 A1 4/2002 Walker et al.
2002/0045484 A1 4/2002 Eck et al.
2002/0057800 A1 5/2002 Gordon et al.
2002/0058546 A2 5/2002 Acres
2002/0065123 A1 5/2002 Packes et al.
2002/0068629 A1 6/2002 Allen et al.
2002/0068631 A1 6/2002 Raverdy et al.
2002/0071557 A1 6/2002 Nguyen
2002/0071560 A1 6/2002 Kurn et al.
2002/0077174 A1 6/2002 Luciano et al.
2002/0080969 A1 6/2002 Giobbi
2002/0116615 A1 8/2002 Nguyen et al.
2002/0123376 A1 9/2002 Walker et al.
2002/0137217 A1 9/2002 Rowe
2002/0138594 A1 9/2002 Rowe
2002/0142828 A1 10/2002 Moody
2002/0144116 A1 10/2002 Giobbi
2002/0151354 A1 10/2002 Boesen et al.
2002/0151356 A1 10/2002 Burns et al.
2002/0151360 A1 10/2002 Durham et al.
2002/0160826 A1 10/2002 Gomez et al.
2002/0169022 A1 11/2002 Canterbury
2002/0173355 A1 11/2002 Walker et al.
2002/0174160 A1 11/2002 Gatto et al.
2002/0174444 A1 11/2002 Gatto et al.
2002/0177483 A1 11/2002 Cannon
2002/0187827 A1 12/2002 Blankstein
2002/0188940 A1 12/2002 Breckner et al.
2003/0027638 A1 2/2003 Schneider et al.
2003/0045351 A1 3/2003 Gauselmann
2003/0045354 A1 3/2003 Giobbi
2003/0054879 A1 3/2003 Schneier et al.
2003/0060259 A1 3/2003 Mierau et al.
2003/0060276 A1 3/2003 Walker et al.
2003/0060286 A1 3/2003 Walker et al.
2003/0064771 A1 4/2003 Morrow et al.
2003/0064795 A1 4/2003 Baerlocher et al.
2003/0064807 A1 4/2003 Walker et al.
2003/0069058 A1 4/2003 Byrne
2003/0073497 A1 4/2003 Nelson
2003/0078089 A1 4/2003 Gray et al.
2003/0078094 A1 4/2003 Gatto et al.
2003/0078101 A1 4/2003 Schneider et al.
2003/0083943 A1 5/2003 Adams et al.
2003/0092489 A1 5/2003 Veradej
2003/0092490 A1 5/2003 Gauselmann
2003/0093669 A1 5/2003 Morais et al.
2003/0100359 A1 5/2003 Loose et al.
2003/0100369 A1 5/2003 Gatto et al.
2003/0100370 A1 5/2003 Gatto et al.
2003/0100371 A1 5/2003 Gatto et al.
2003/0100372 A1 5/2003 Gatto et al.
2003/0104854 A1 6/2003 Cannon
2003/0115351 A1 6/2003 Giobbi
2003/0140134 A1 7/2003 Swanson et al.
2003/0162589 A1 8/2003 Nguyen et al.
2003/0171145 A1 9/2003 Rowe
2003/0171149 A1 9/2003 Rothschild
2003/0176216 A1 9/2003 Storey
2003/0176219 A1 9/2003 Manfredi et al.
2003/0181231 A1 9/2003 Vancura et al.
2003/0186736 A1* 10/2003 Benbrahim ..... G07F 17/32 463/20
2003/0188306 A1 10/2003 Harris et al.
2003/0190941 A1 10/2003 Byrne
2003/0195033 A1 10/2003 Gazdic et al.
2003/0212597 A1 11/2003 Ollins
2003/0216182 A1 11/2003 Gauselmann
2003/0224852 A1 12/2003 Walker et al.
2003/0228901 A1 12/2003 Walker
2003/0228904 A1 12/2003 Acres et al.
2003/0228907 A1 12/2003 Gatto et al.
2003/0228912 A1 12/2003 Wells et al.
2003/0232650 A1 12/2003 Beatty
2004/0002379 A1 1/2004 Parrott et al.
2004/0002381 A1 1/2004 Alcorn et al.
2004/0002385 A1 1/2004 Nguyen
2004/0003389 A1 1/2004 Reynar et al.
2004/0005919 A1 1/2004 Walker et al.
2004/0010700 A1 1/2004 Mont
2004/0014522 A1 1/2004 Walker
2004/0015423 A1 1/2004 Walker et al.
2004/0023721 A1 2/2004 Giobbi
2004/0024666 A1 2/2004 Walker et al.
2004/0029635 A1 2/2004 Giobbi
2004/0033831 A1 2/2004 Tarantino
2004/0038723 A1 2/2004 Schneier et al.
2004/0048660 A1 3/2004 Gentles et al.
2004/0048667 A1 3/2004 Rowe
2004/0053664 A1 3/2004 Byrne
2004/0054952 A1 3/2004 Morrow et al.
2004/0063489 A1 4/2004 Crumby
2004/0072604 A1 4/2004 Toyoda
2004/0072608 A1 4/2004 Toyoda
2004/0072618 A1 4/2004 Bartholomew et al.
2004/0082373 A1 4/2004 Cole et al.
2004/0082385 A1 4/2004 Silva et al.
2004/0092310 A1 5/2004 Brosnan et al.
2004/0098597 A1 5/2004 Giobbi
2004/0106452 A1 6/2004 Nguyen et al.
2004/0110557 A1 6/2004 Rowe
2004/0124243 A1 7/2004 Gatto et al.
2004/0127279 A1 7/2004 Gatto et al.
2004/0132532 A1 7/2004 Brosnan et al.
2004/0133485 A1 7/2004 Schoonmaker et al.
2004/0142739 A1 7/2004 Loose et al.
2004/0142742 A1 7/2004 Schneider et al.
2004/0152509 A1 8/2004 Hornik et al.
2004/0162144 A1 8/2004 Loose et al.
2004/0166923 A1 8/2004 Michaelson et al.
2004/0166931 A1 8/2004 Criss-Puszkiewicz et al.
2004/0166940 A1 8/2004 Rothschild
2004/0166942 A1 8/2004 Muir
2004/0176162 A1 9/2004 Rothschild
2004/0176167 A1 9/2004 Michaelson et al.
2004/0179701 A1 9/2004 Boyd
2004/0180721 A1 9/2004 Rowe
2004/0180722 A1 9/2004 Giobbi
2004/0185936 A1 9/2004 Block et al.
2004/0193726 A1 9/2004 Gatto et al.
2004/0198494 A1 10/2004 Nguyen et al.
2004/0198496 A1 10/2004 Gatto et al.
2004/0204244 A1 10/2004 Rathsack et al.
2004/0214622 A1 10/2004 Atkinson
2004/0214627 A1 10/2004 Jordan et al.
2004/0214640 A1 10/2004 Giobbi
2004/0214641 A1 10/2004 Giobbi
2004/0215756 A1 10/2004 VanAntwerp et al.
2004/0219967 A1 11/2004 Giobbi et al.
2004/0219983 A1 11/2004 Giobbi
2004/0224770 A1 11/2004 Wolf et al.
2004/0229684 A1 11/2004 Blackburn et al.

(56) References Cited

U.S. PATENT DOCUMENTS

2004/0229698 A1 11/2004 Lind et al.
2004/0229699 A1 11/2004 Gentles et al.
2004/0235559 A1 11/2004 Brosnan et al.
2004/0235563 A1 11/2004 Blackburn et al.
2004/0242298 A1 12/2004 Inamura et al.
2004/0242328 A1 12/2004 Blackburn et al.
2004/0242329 A1 12/2004 Blackburn et al.
2004/0242330 A1 12/2004 Blackburn et al.
2004/0242331 A1 12/2004 Blackburn et al.
2004/0243848 A1 12/2004 Blackburn et al.
2004/0243849 A1 12/2004 Blackburn et al.
2004/0248642 A1 12/2004 Rothschild
2004/0248645 A1 12/2004 Blackburn et al.
2004/0248646 A1 12/2004 Canterbury
2004/0248651 A1 12/2004 Gagner
2004/0254006 A1 12/2004 Lam et al.
2004/0254013 A1 12/2004 Quraishi et al.
2004/0254014 A1 12/2004 Quraishi et al.
2004/0254954 A1 12/2004 Gatto et al.
2004/0255139 A1 12/2004 Giobbi
2004/0259629 A1 12/2004 Michaelson et al.
2004/0259633 A1 12/2004 Gentles et al.
2004/0259640 A1 12/2004 Gentles et al.
2004/0259643 A1 12/2004 Gentles
2004/0266532 A1 12/2004 Blackburn et al.
2004/0266533 A1 12/2004 Gentles et al.
2005/0003886 A1 1/2005 Englman et al.
2005/0009599 A1 1/2005 Ryan
2005/0009601 A1 1/2005 Manfredi et al.
2005/0009607 A1 1/2005 Russell et al.
2005/0010738 A1 1/2005 Stockdale et al.
2005/0014559 A1 1/2005 Mattice et al.
2005/0020354 A1 1/2005 Nguyen et al.
2005/0026679 A1 2/2005 Lucchesi et al.
2005/0032573 A1 2/2005 Acres et al.
2005/0032577 A1 2/2005 Blackburn et al.
2005/0037708 A1 2/2005 Torvinen
2005/0043072 A1 2/2005 Nelson
2005/0043088 A1 2/2005 Nguyen et al.
2005/0043090 A1 2/2005 Pryzby et al.
2005/0043094 A1 2/2005 Nguyen et al.
2005/0044535 A1 2/2005 Coppert
2005/0049037 A1 3/2005 Anderson et al.
2005/0054431 A1 3/2005 Walker et al.
2005/0054435 A1 3/2005 Rodgers et al.
2005/0054438 A1 3/2005 Rothschild et al.
2005/0054445 A1 3/2005 Gatto et al.
2005/0054447 A1 3/2005 Hiroyama et al.
2005/0054448 A1 3/2005 Frerking et al.
2005/0059457 A1 3/2005 Rothschild et al.
2005/0059493 A1 3/2005 Tyson et al.
2005/0059494 A1 3/2005 Kammler
2005/0064939 A1 3/2005 McSheffrey et al.
2005/0075983 A1 4/2005 St. Denis
2005/0081623 A1 4/2005 Frank
2005/0086286 A1 4/2005 Gatto et al.
2005/0090313 A1 4/2005 Rowe
2005/0096114 A1 5/2005 Cannon et al.
2005/0096126 A1 5/2005 Prasad et al.
2005/0096133 A1 5/2005 Hoefelmeyer et al.
2005/0097342 A1 5/2005 Gatto et al.
2005/0101370 A1 5/2005 Lind et al.
2005/0101376 A1 5/2005 Walker
2005/0113172 A1 5/2005 Gong
2005/0114272 A1 5/2005 Herrmann et al.
2005/0119045 A1 6/2005 Fujimoto
2005/0119046 A1 6/2005 Fujimoto
2005/0120672 A1 6/2005 Gargiulo
2005/0137012 A1 6/2005 Michaelson
2005/0148385 A1 7/2005 Michaelson
2005/0153768 A1 7/2005 Paulsen
2005/0153773 A1 7/2005 Nguyen et al.
2005/0159200 A1 7/2005 Nicely et al.
2005/0187014 A1* 8/2005 Saffari ..... A63F 13/00 463/27
2005/0239546 A1 10/2005 Hedrick et al.
2005/0261059 A1 11/2005 Nguyen et al.
2005/0261060 A1 11/2005 Nguyen et al.
2005/0261061 A1 11/2005 Nguyen et al.
2005/0266919 A1 12/2005 Rowe et al.
2005/0282629 A1 12/2005 Gagner
2005/0282638 A1 12/2005 Rowe
2006/0009273 A2 1/2006 Moshal
2006/0019747 A1 1/2006 Loose et al.
2006/0019750 A1 1/2006 Beatty
2006/0030409 A1 2/2006 Lechner et al.
2006/0031829 A1 2/2006 Harris et al.
2006/0035705 A1 2/2006 Jordan et al.
2006/0036573 A1 2/2006 Watanabe et al.
2006/0039132 A1 2/2006 Chen
2006/0040732 A1 2/2006 Baerlocher et al.
2006/0046839 A1 3/2006 Nguyen
2006/0052160 A1 3/2006 Saffari et al.
2006/0084497 A1* 4/2006 Marks ..... G07F 17/32 463/20
2006/0084502 A1 4/2006 Downs et al.
2006/0094508 A1 5/2006 D'Amico et al.
2006/0121969 A1* 6/2006 Marks ..... G07F 17/32 463/16
2006/0143085 A1 6/2006 Adams et al.
2006/0148561 A1 7/2006 Moser
2006/0172792 A1 8/2006 Vancura
2006/0183535 A1* 8/2006 Marks ..... G07F 17/3244 463/20
2006/0194633 A1 8/2006 Paulsen
2006/0217183 A1 9/2006 Mierau et al.
2006/0287107 A1 12/2006 Okada
2007/0021182 A1 1/2007 Gauselmann
2007/0021187 A1 1/2007 Gauselmann
2007/0054733 A1 3/2007 Baerlocher
2007/0060321 A1 3/2007 Vasquez et al.
2007/0149268 A1 6/2007 Gauselmann
2007/0191088 A1 8/2007 Breckner
2007/0243925 A1 10/2007 LeMay
2007/0298875 A1 12/2007 Baerlocher et al.
2008/0032782 A1 2/2008 Boesen et al.
2008/0039191 A1 2/2008 Cuddy
2008/0064492 A1 3/2008 Oosthoek
2008/0090651 A1 4/2008 Baerlocher
2008/0132324 A1 6/2008 Toyoda
2008/0194312 A1 8/2008 Nelson et al.
2008/0254858 A1 10/2008 Fujimoto et al.
2008/0311973 A1 12/2008 Jaffe
2009/0082099 A1 3/2009 Luciano, Jr.
2009/0239639 A1 9/2009 Yoshizawa
2010/0267444 A1 10/2010 Walker et al.

FOREIGN PATENT DOCUMENTS

EP 0 984 409 3/2000
EP 1 004 970 5/2000
EP 1 199 690 2/2004
EP 0 813 132 1/2005
EP 1 378 873 3/2005
EP 1 238 688 5/2005
EP 1 378 874 5/2005
EP 1 471 710 5/2005
EP 1 291 048 6/2005
GB 2 098 778 11/1982
GB 2 139 390 11/1984
GB 2 144 644 3/1985
GB 2 151 054 7/1985
GB 2 191 030 12/1987
GB 2 222 712 3/1990
GB 2 333 880 8/1999
GB 2 353 128 2/2001
WO WO 9835309 8/1998
WO WO 9941718 8/1999
WO WO 9965579 12/1999
WO WO 00/12186 3/2000
WO WO 0025281 5/2000
WO WO 0032286 6/2000
WO WO 0067424 11/2000
WO WO 0158550 8/2001

(56) References Cited

FOREIGN PATENT DOCUMENTS

| | | |
|---|---|---|
| WO | WO 0161437 | 8/2001 |
| WO | WO 03045515 | 6/2003 |
| WO | WO 03045516 | 6/2003 |
| WO | WO 2004004855 | 1/2004 |
| WO | WO 2004103495 | 12/2004 |
| WO | WO 2005028056 | 3/2005 |
| WO | WO 2005029220 | 3/2005 |
| WO | WO 2005033825 | 4/2005 |
| WO | WO 2005033826 | 4/2005 |
| WO | WO 2005120672 | 12/2005 |
| WO | WO 2006027677 | 3/2006 |
| WO | WO 2006039067 | 4/2006 |

* cited by examiner

FIG. 5

16,18

If a winning combination is generated and your winning symbol combination is the lucky number of total winning symbol combinations, you win this progressive award:

Total Winning Symbol Combinations Progressive Award: $1,054.65 — 140

If a bonus game is triggered and your triggered bonus game is the lucky number of total triggered bonus games, you win this progressive award:

Total Triggers of Bonus Game Progressive Award: $376.78 — 142

If a 7 symbol is generated and your generated 7 symbol is the lucky number of total generated 7 symbols, you win this progressive award:

Total Generated 7 Symbols Progressive Award: $3,200,873.88 — 144

If your wagered on payline is the lucky number of total wagered on paylines, you win this progressive award:

Total Number of Wagered-On Paylines Progressive Award: $597,663.35 — 146

GAMING SYSTEM AND METHOD FOR PROVIDING DIFFERENT BONUS AWARDS BASED ON DIFFERENT TYPES OF TRIGGERED EVENTS

PRIORITY CLAIM

This application is a continuation of, claims priority to and the benefit of U.S. patent application Ser. No. 14/546,785, filed on Nov. 18, 2014, which is a divisional of, claims priority to and the benefit of U.S. patent application Ser. No. 11/837,151, filed on Aug. 10, 2007 now U.S. Pat. No. 8,900,053, the entire contents of which are each incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one cent, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game ranging, for example, from one credit up to 125 credits (e.g., five credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

Progressive awards associated with gaming machines are also known. In one form, a progressive award is an award amount which includes an initial amount and an additional amount funded through a portion of each wager made on the progressive gaming machine. For example, 0.1% of each wager placed on the primary game of a gaming machine may be allocated to the progressive award or progressive award fund. The progressive award grows in value as more players play the gaming machine and more portions of the players' wagers are allocated to the progressive award. When a player obtains a winning symbol or symbol combination which results in the progressive award, the accumulated progressive award is provided to the player. After the progressive award is provided to the player, the amount of the next progressive award is reset to the initial value and a portion of each subsequent wager is allocated to the next progressive award.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressives ("LAP") and wide area progressives ("WAP"), respectively.

Mystery bonus awards are also known. Such bonus awards are classified as mystery awards because they are not based on any generated symbol or symbol combination nor is it readily apparent to the player why such bonus award(s) are provided. One type of known mystery bonus award is associated with a range of values. For this type of mystery bonus award, a triggering event occurs and a progressive award is provided to a player of a gaming device in the gaming system when that progressive award increments or increases to a designated value (i.e., the progressive hit value) within the range of values associated with that progressive award. For example, a first progressive award is associated with a value range of $10 to $100 wherein, a triggering event will occur and the first progressive award will be provided to a player when the value of the first progressive award increments to a first progressive hit value of $54.65. It should be appreciated that the amount which this progressive award may be incremented to is capped or limited by the highest value in the value range associated with such progressive award.

While such mystery progressive awards are popular amongst players, a number of problems exist with these known mystery progressive award gaming systems. For example, when a progressive award is provided at a different gaming machine, a player may feel deflated and not wish to continue playing for a base or reset level progressive award. Such feelings can lead to certain players walking away with jackpot fatigue. That is, jackpot fatigue can occur when a player no longer finds an award desirable or worth the cost of continuing to play. This desire to quit playing is also due to the fact that a player may feel they must wait a substantial period of time for the progressive award to climb back to a high value.

Moreover, as each player's primary game wager increments the mystery progressive award and the mystery progressive award is provided when the value of the progressive award increments to the progressive hit value, such a mystery progressive award is provided based on each player's primary game wager placed. Such a configuration discourages players who do not want to place the maximum wager amount on the primary game because they will have a less chance of winning the mystery progressive award.

There is a continuing need to provide new and different gaming machines and gaming systems as well as new and different ways to provide awards to players including bonus awards.

SUMMARY

In one embodiment, the gaming system disclosed herein includes at least one progressive award, jackpot award or other designated award adapted to be provided to a player of one of a plurality of gaming machines or gaming devices. In operation, a central server, central controller or remote host tracks the occurrences of one or more suitable events occurring at or in association with one or more gaming devices in the gaming system. Upon the central server determining that the quantity of tracked occurrences of the suitable event has reached a designated quantity or threshold, (i.e., an occurrence of a triggering event), the central controller causes one of the gaming devices in the gaming system to provide the progressive award, jackpot award or other designated award to a player. By linking each gaming device in the gaming system with the central server, the gaming system disclosed herein is operable to identify and track any occurrence of any event at any of the linked gaming devices. Such a configuration provides that any suitable event, regardless of how often that event occurs, may be tracked and tied to the trigger of the gaming system providing one or more progressive awards to one or more players.

In different embodiments, the central server of the gaming system disclosed herein is operable to track or otherwise account for the quantity of occurrences of any suitable event which occurs and in association with (a) one or more plays of one or more primary games at one or more of the gaming devices, (b) one or more plays of one or more secondary games at one or more of the gaming devices, and/or (c) one or more occurrences at one or more of the gaming devices which are independent of any primary or secondary games played. By tracking one or more gaming experience events which are independent of any values of any primary game wagers placed (and the amounts of such wagers placed), one embodiment of the gaming system disclosed herein provides that all the players have an equal (or substantially equal) probability of winning a progressive award, regardless of the amount of each player's wager placed. In one such embodiment, to account for providing different players that place different wager amounts an equal (or substantially equal) probability of winning a progressive award, if a progressive award triggering event occurs, different players are provided different proportions of the progressive award. In this embodiment, the proportion of the progressive award provided to each player is based on that player's wager amount. Such a configuration provides that different players wagering at different wager levels are provided different proportions of a progressive award which is determined to be provided based on a designated quantity of occurrences of any identifiable and traceable event at any of the linked gaming devices in the gaming system.

In one embodiment, the gaming system includes a plurality of different types of progressive awards adapted to be provided to one or more players of the gaming machines in the gaming system. In one embodiment, the different types of progressive awards are provided to the player based on the occurrences of one or more different triggering or qualifying conditions or criteria. For example, at least one progressive award is provided when a quantity or number of tracked occurrences of a first identifiable event reaches a designated quantity or number of occurrences. In this example, at least another progressive award is provided when a quantity or number of tracked occurrences of a second, different identifiable event reaches a designated quantity or number of occurrences. Such different triggering events for different progressive awards significantly increases the probability that at least one incremented progressive award will be available at any time as well as significantly increases the probability that, at any given time, the gaming system will be offering at least one progressive award that a player views as valuable or worth trying for.

In one embodiment, at least one of the progressive awards in the gaming system is associated with a number of primary game outcome generations or plays of a primary game. In this embodiment, the central server tracks a quantity or number of primary game outcome generations at the gaming devices in the gaming system, such as tracking a quantity or number of activations of different gaming devices' sets of reels. For each primary game award which is generated at a participating gaming device, such as each time the set of reels of a gaming device are activated to generate a plurality of symbols, the central server increments a counter or meter to track such an occurrence, regardless of the amount of the wager placed to activate the set of reels. After incrementing the meter, the central server determines if a designated number of primary game outcome generations (e.g., total gaming device reel activations) has been reached for the participating gaming devices in the gaming system. If the designated number of primary game outcome generations has been reached, the central server provides the progressive award associated with the number of primary game outcome generations to one of the players at one of the gaming devices in the gaming system. Accordingly, the gaming system disclosed herein causes a progressive award triggering event to occur and provides a progressive award to a player based on a number of occurrences of an event tracked in association with one or more player's gaming experiences.

In another such embodiment, at least one of the progressive awards in the gaming system is associated with a quantity or number of paylines which are wagered on at the participating gaming devices in the gaming system. In this embodiment, the central server tracks the quantity or number of paylines which are wagered on at the participating gaming devices in the gaming system. Upon the central server determining that a designated quantity of paylines have been wagered on at the gaming devices in the gaming system (i.e., a threshold of wagered on paylines has been reached), the central server provides the progressive award associated with such tracked gaming event to one of the players at one of the gaming devices in the gaming system.

In another such embodiment, at least one of the progressive awards in the gaming system is associated with a quantity or number of generations of a designated symbol or symbol combination. In this embodiment, the central server tracks the quantity or number of generations of a designated symbol or symbol combination at the participating gaming devices in the gaming system. Upon the central server determining that the designated symbol or symbol combination has been generated a designated number of times at the participating gaming devices in the gaming system (i.e., a threshold of generations of the designated symbol or symbol combination has been reached), the central server provides the progressive award associated with such tracked gaming event to one of the players at one of the gaming devices in the gaming system.

In another embodiment, the gaming system is operable to group certain players together into different player groups. In one such embodiment, which player group a player is placed in or otherwise associated with is based on the player tracking status or ranking (obtained via a player tracking system) associated with that player. In different embodiments, which player group a player is placed in or otherwise associated with is based on the type of games the player plays, randomly determined, predetermined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on the amount of coin-in accumulated in one or more pools, or determined based on any other suitable method or criteria.

In these embodiments, each player group is associated with a separate progressive award and a separate threshold of traceable events which must occur (and be tracked by the central server accordingly) to trigger a gaming device providing that progressive award to a player. In this embodiment, upon the central server determining that a quantity of occurrences of a tracked event has reached a threshold (i.e., a progressive award triggering event has occurred), the gaming system provides the progressive award associated with the player group to one of the players in the player group that is playing one of the gaming devices in the gaming system.

In one example embodiment, a first progressive award is provided to a player from a first group of players when a first number or quantity of gaming events occur at gaming devices played by players from this first group. In this example embodiment, a second progressive award is provided to a player from a second, higher player tracking level group of players when a second, lower number or quantity of gaming events occur at gaming devices played by players from this second group. Accordingly, in this example embodiment, the players of the second, higher player tracking level group of players have a greater relative probability of winning a progressive award (relative to the number of games played by the players in that group) than the players of the first group of players due to the lower threshold of traceable events. Such a configuration provides that different players with different characteristics may be segmented and providing different probabilities of winning progressive awards based on these characteristics.

In one embodiment, one, more or each of the progressive awards are maintained by the central controller of the gaming system. In another embodiment, one, more or each of the progressive awards are maintained by the individual gaming devices. For example, the progressive award(s) provided upon a designated quantity or threshold of paylines being wagered on may be maintained by the central controller (and thus obtainable by any player at any gaming device in the gaming system) while the progressive award(s) provided upon a designated quantity or threshold of secondary game triggering events occurring may be maintained by each individual gaming device (and thus obtainable by the player playing that individual gaming device). It should be appreciated that any suitable configuration of maintaining one, more or each of the progressive awards may be implemented in accordance with the gaming system disclosed herein. It should be further appreciated that while the determination of when a progressive award triggering event will occur is dependent on a quantity of occurrences of a tracked gaming event reaching a threshold quantity and, in one embodiment, independent of any values of any wagers placed, the amount or value of the provided progressive award is at least in part funded by or otherwise based on the values of any wagers placed.

Accordingly, an advantage of the gaming system and method disclosed herein is to provide a gaming system and method having a plurality of gaming devices wherein one or more progressive awards may be provided to one or more players based on a quantity of occurrences of any suitable event. By implementing a central server, central controller or remote host to track such occurrences, the gaming system and method disclosed herein provides that a progressive award triggering condition may occur in association with any event or occurrence which is part of the player's gaming experience. Such a gaming system and method provides increased excitement and enjoyment to players because any action or decision the player makes in association with their gaming experience may lead to the player winning one or more progressive awards.

Another advantage of the gaming system and method disclosed herein is to provide a gaming system and method having a plurality of gaming devices wherein one or more progressive awards may be provided to one or more players either sequentially, simultaneously or substantially simultaneously. Maintaining a plurality of progressive awards provides for more frequent wins of the progressive awards which breaks up the relatively long periods of time it often takes to build the progressives to the appropriate levels desirable by a player. Providing a plurality of different progressive awards which are triggered or hit at different times or based on different and/or independent triggering events results in always or almost always having at least one progressive award available that is incremented to desirable levels. Providing different types of progressive awards which have different frequencies of being hit therefore provides increased enjoyment and excitement for players.

Additional features and advantages are described in, and will be apparent from, the following Detailed Description and the figures.

BRIEF DESCRIPTION OF THE FIGURES

FIG. 5 is a top plan view of a display device of one embodiment of the gaming device disclosed herein illustrating the plurality of progressive awards which may be won by the player and the different criteria necessary to win such progressive awards.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
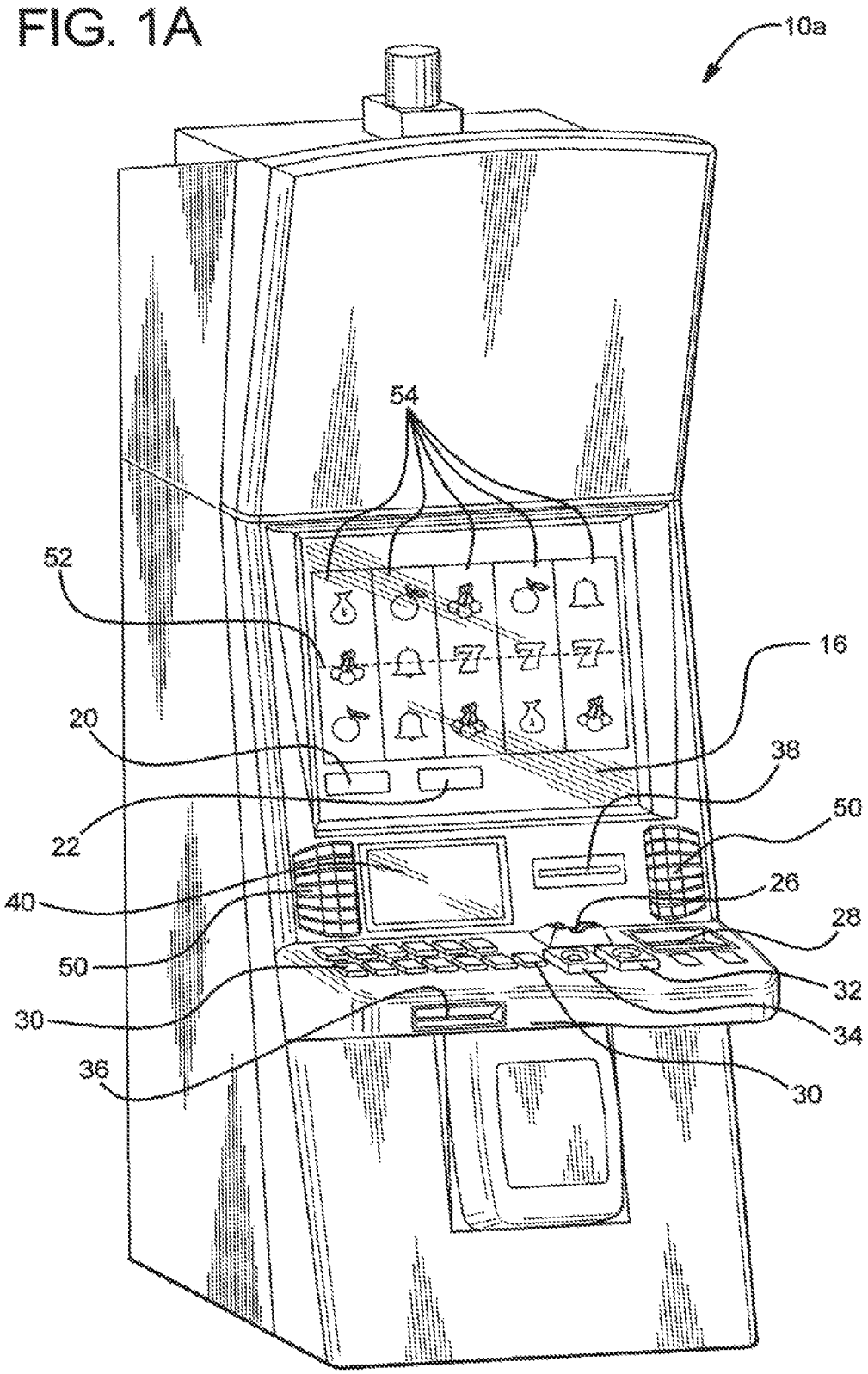
FIG. 1A is a front-side perspective view of one embodiment of the gaming device disclosed herein.
Figure 1B:
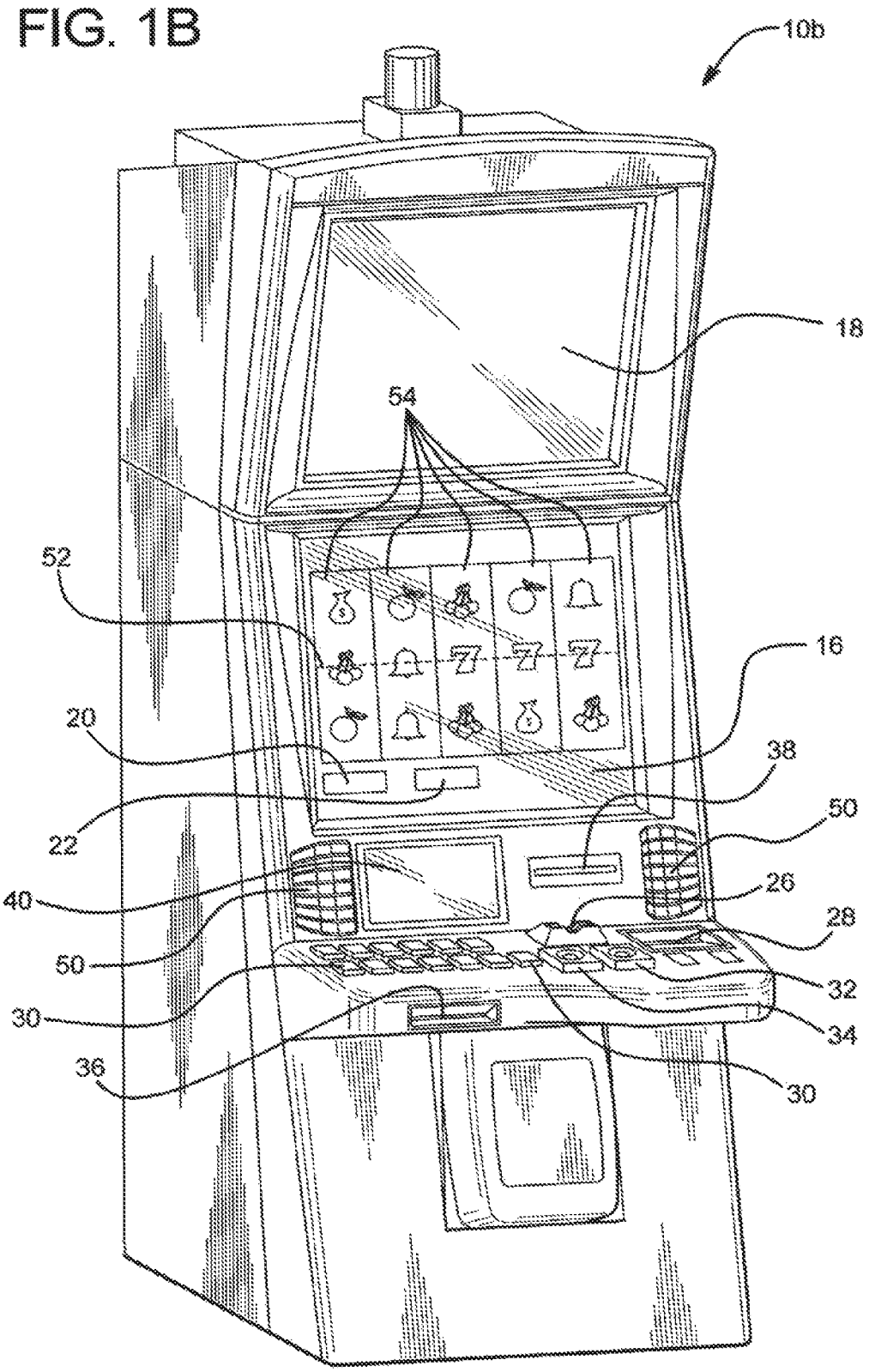
FIG. 1B is a front-side perspective view of another embodiment of the gaming device disclosed herein.
Figure 1C:
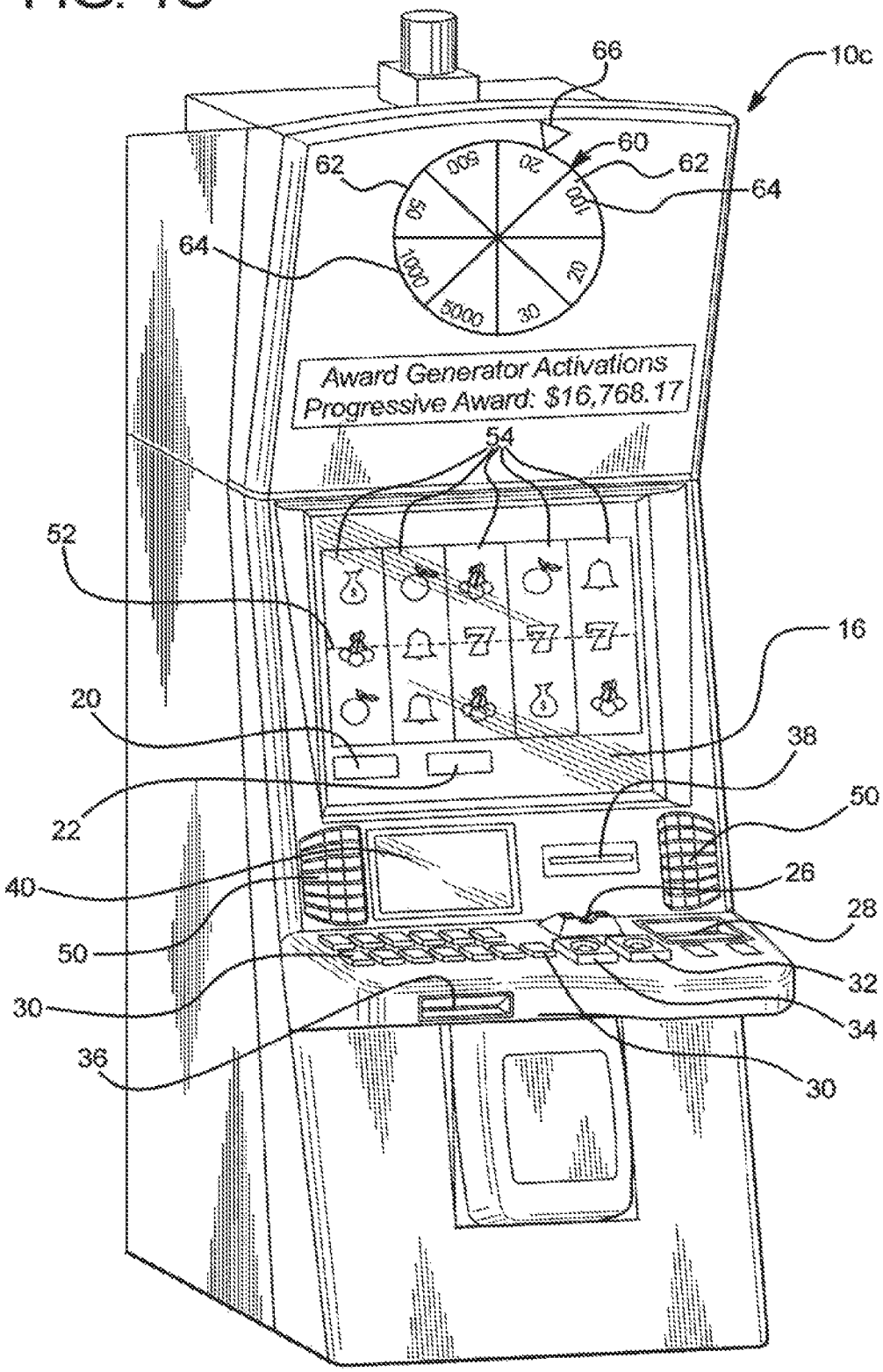
FIG. 1C is a front-side perspective view of another embodiment of the gaming device disclosed herein.

Referring now to the drawings, two example alternative embodiments of the gaming device disclosed herein are illustrated in FIGS. 1A, 1B and 1C as gaming device 10*a*, gaming device 10*b*, and gaming device 10*c*, respectively. Gaming device 10*a*, gaming device 10*b* and/or gaming device 10*c* are generally referred to herein as gaming device 10.

In the embodiments illustrated in FIGS. 1A, 1B and 1C, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A, 1B and 1C, the gaming device may have varying cabinet and display configurations.

Figure 2A:
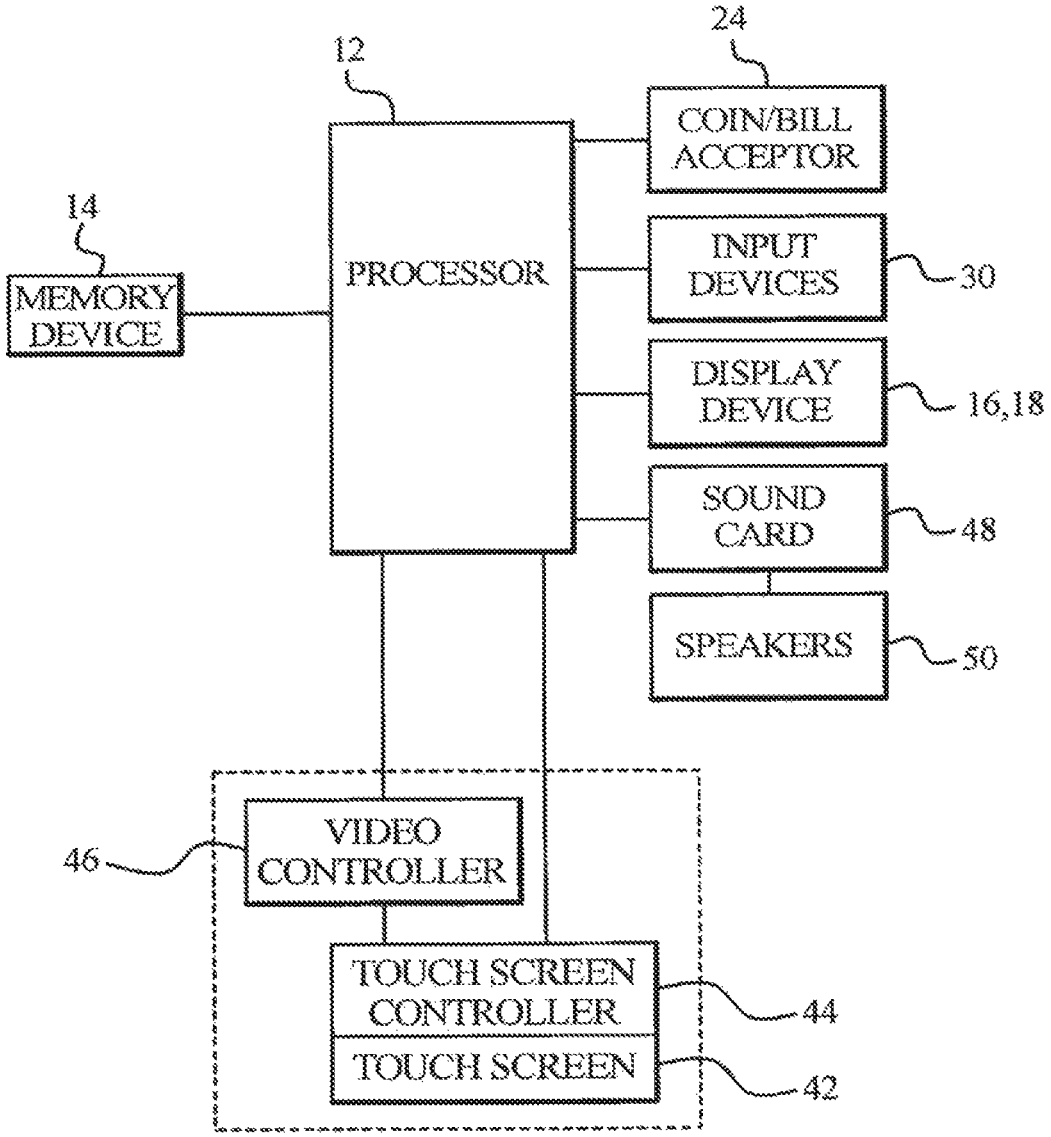
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A, 1B and 1C, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

In one embodiment, as seen in FIG. 1C, the gaming device includes an award generator, such as the wheel 60. In this embodiment, the award generator is divided into a plurality of sections 62. Each section includes or is associated with an award or outcome 64. For example, one section is associated with the award of five-hundred and another section is associated with the award of five-thousand. In different embodiments, the awards associated with the sections of the award generator may be predetermined, randomly determined, determined based on the player's wager, determined based on the status of one or more players (such as determined through a player tracking system), determined based on time, or determined based on any other suitable method. The awards or outcomes may be any suitable award or outcome such as, but not limited to, a value, a multiplier, a modifier, a number of free games, or a replay of one or more previous games. In one alternative embodiment, the awards are adapted to be changeable between games, such as based on betting history, or based upon any suitable factor.

As illustrated in FIG. 2A, in one embodiment, the gaming device includes at least one payment device 24 in communication with the processor. As seen in FIGS. 1A, 1B and 1C, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, 1C and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A, 1B and 1C, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A, 1B and 1C. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
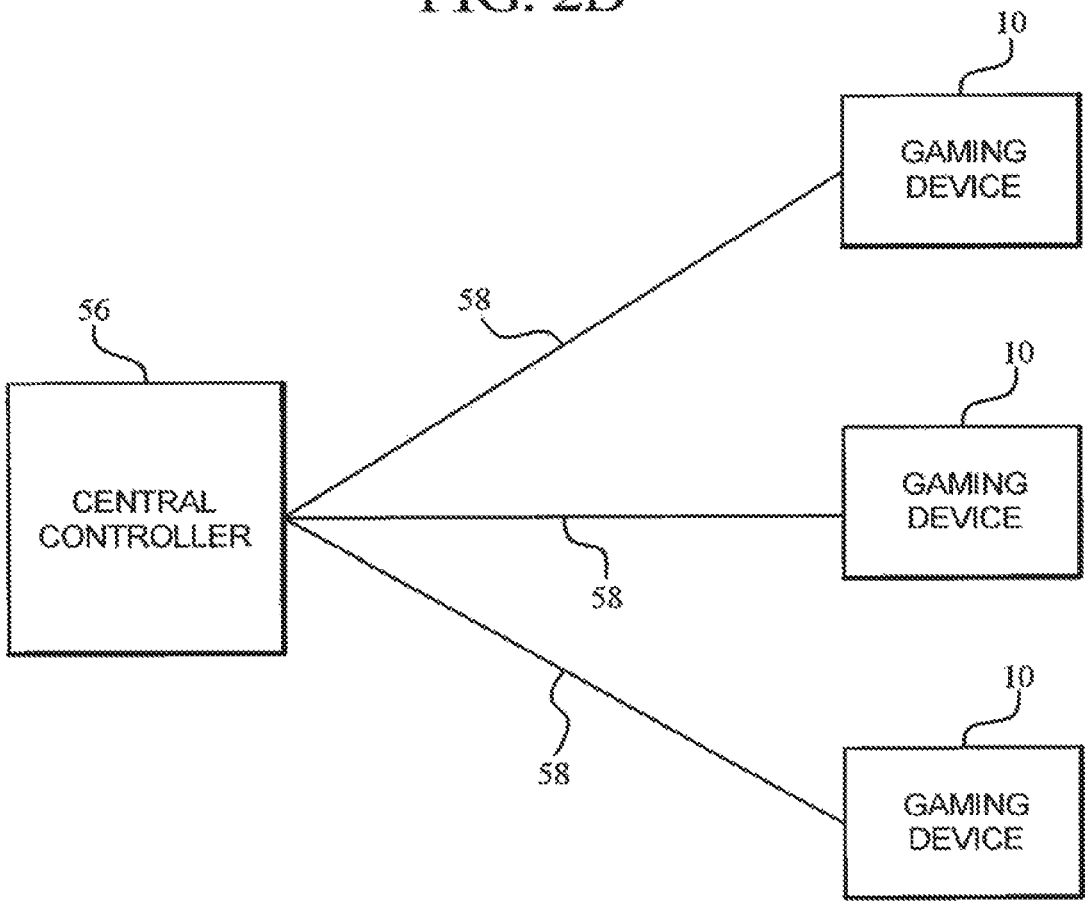
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Progressive Awards

In one embodiment, a plurality of gaming devices at one or more gaming sites are networked to the central server in a progressive configuration, wherein a portion of each wager placed is allocated to one or more progressive awards. In one embodiment, the progressive awards are associated with the system of gaming machines which each contribute portions of the progressive awards. In one such embodiment, different progressive awards are associated with different numbers of gaming devices. For example, a progressive award valued at $10,000 may be associated with ten gaming devices while another progressive award valued at $500,000 may be associated with one-hundred gaming devices. In one embodiment, the multiple gaming machines may be in the same bank of machines, in the same casino or gaming establishment such as through a LAN or in two or more different casinos or gaming establishments such as through a WAN. In another embodiment, each individual gaming machine maintains one or more progressive awards wherein a portion of each wager placed at that respective gaming machine is allocated to one or more progressive awards maintained by such individual gaming machine. In another embodiment, each individual gaming machine maintains one or more progressive awards and the central server simultaneously or substantially simultaneously maintains one or more progressive awards. In one such embodiment, the lower valued, more frequently triggered progressive awards are maintained by the individual gaming machines and the higher valued, less frequently triggered progressive awards are maintained by the central server.

In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state. In one embodiment, the host site computer is maintained for the overall operation and control of the system. In this embodiment, a host site computer oversees all or part of the progressive gaming system and is the master for computing all or part of the progressive jackpots. All participating gaming sites report to, and receive information from, the host site computer. Each central server computer is responsible for all data communication between the gaming device hardware and software and the host site computer.

In one embodiment, more than one of the progressive awards start at the same level, such as $1000 and increment or increase until provided to a player. In another embodiment, more than one of the progressive awards start at different levels such as $10, $100, $1000 and $10,000 and increment or increase until provided to a player. The progressive awards accumulate based on a small percentage (such as 0.1%) of coin-in or wagered amounts in a conventional manner. In one embodiment, the percentage that goes to each progressive award is equal (such as 0.1% to each of four progressive awards). At this accrual rate, player wagers totaling $1,000,000 are required for the progressive to reach $1000. In one embodiment, at least a fraction of this amount may be funded by the casino by using a starting value higher than zero to make the progressives attractive even after they are reset. In other embodiments, two or more of the progressive awards may be funded by different percentages. In these embodiments, the central server and/or individual gaming device processor continues to increase the progressive levels until a progressive award is provided to a player (upon the occurrence of a progressive award triggering event), at which point the progressive is reset and another progressive award starts incrementing from the appropriate default progressive award level. In another embodiment, one or more progressive awards increment a predetermined amount per game played. In one such embodiment, this incremental amount is partially funded by an amount of the wagers placed and is partially funded by an amount provided by a gaming establishment marketing or advertisement department. In different embodiments, the gaming establishment marketing or advertisement department provides a value or amount to the progressive award based on matching a percentage of wagers placed, a predetermined amount for each game played, an elapsed period of time, or any other suitable manner.

In another embodiment, two or more of the progressive awards may be funded at different temporal rates. In this embodiment, the different progressive awards are incremented or funded in different increments of time wherein until the progressive hits, a set amount is added to the progressive at each determined time increment. In another embodiment, two or more of the progressive awards may each be incremented or funded based on different incrementing factors or incrementors. In this embodiment, a first of the progressive awards may increment each time a first incrementing factor occurs and a second of the progressive awards may increment each time a second incrementing factor occurs, wherein the first incrementing factor and the second incrementing factor are different. Examples of incrementing factors could be a symbol-driven trigger in the base game, the player betting a maximum amount, a percentage of possible gaming machines being actively played or in active status, or any other suitable method for defining an incrementor.

In one embodiment, one or more of the progressive awards are funded, at least partially, via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed. In another embodiment, one or more progressive awards are funded, at least partially, via an amount provided by one or more marketing and/or advertising departments, such as a casino's marketing department.

In one alternative embodiment, a minimum wager level is required for a gaming machine to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In one embodiment, as described in more detail below, the central server or other central controller determines when one or more progressive award wins are triggered. In this embodiment, a central controller and an individual gaming machine work in conjunction with each other to determine when a progressive award win is triggered, for example through an individual gaming machine meeting a predetermined requirement or criteria established by the central controller. In one such embodiment, upon a determination to track one or more gaming events, the central controller sets a meter associated with the tracked gaming event to a designated amount, such as zero. In this embodiment, the central controller notifies each eligible or participating gaming device in the gaming system regarding which gaming event or gaming events will be tracked. In another embodiment, an individual gaming machine may determine when one or more progressive award wins are triggered. In another embodiment, an individual gaming machine may determine when at least one progressive award win is triggered and the central controller determines when at least one progressive award win is triggered.

In another embodiment, the gaming system includes a plurality of different progressive awards having different triggering factors which are adapted to be provided to one or more players of the gaming machines in the gaming system. In one embodiment, the different progressive awards are provided to the player based on the occurrences of one or more different triggering or qualifying conditions or criteria. For example, at least one progressive award is provided when a quantity or number of tracked occurrences of a first identifiable event, such as a number of paylines wagered on, reaches a designated quantity or number of occurrences. In this example, at least another progressive award is provided when a quantity or number of tracked occurrences of a second, different identifiable event, such as a number of award generations utilizing an award generator, reaches a designated quantity or number of occurrences. Such different triggering events for different progressive awards significantly increases the probability that at least one incremented progressive award will be available at any time as well as significantly increases the probability that, at any given time, the gaming system will be offering at least one progressive award that a player views as valuable or worth trying for. In one embodiment, the gaming devices of the gaming system are operable to provide multiple progressive awards to multiple players at the multiple linked gaming devices at the same time or substantially the same time. Alternatively, the gaming devices of the gaming system are operable to provide multiple progressive awards to multiple players at the multiple linked gaming devices in an overlapping or sequential manner.

In one embodiment, different gaming devices in the gaming system have different progressive awards available to a player. In one such embodiment, different types of gaming devices are associated with different types of progressive awards based on the current configuration of the gaming system. In one embodiment, zero, one or more progressive awards may be associated with each of the gaming devices in the gaming system while zero, one or more different progressive awards may be associated with a plurality of, but not all of the gaming devices in the gaming system. For example, both a first set of gaming devices and a second, different set of gaming devices may be associated with a first type of progressive award which is provided based on a quantity or number of tracked occurrences of wagered on paylines reaching a designated threshold amount, but the first set of gaming devices is also associated with a second type of progressive award (which the second set of gaming devices is not) which is provided based on a quantity or number of tracked occurrences of secondary game triggering events reaching a designated threshold amount.

In one embodiment, at least one and preferably a plurality of the progressive awards maintained by the gaming system are provided to players of the linked gaming machines in an apparently random fashion as perceived by the players of these gaming machines. These progressive awards are distinguished from the awards that the gaming machines provide to the players for displayed winning outcomes in the plays of the primary wagering games, such as slot games, card games (e.g., poker, blackjack) or any other suitable game.

In one embodiment, the gaming devices do not provide any apparent reasons to the players for obtaining such progressive awards. In this embodiment, providing the progressive awards is not triggered by a displayed event in the primary game or based specifically on any of the plays of any primary game or on any of the plays of any secondary game of the gaming machines in the system. That is, these progressive awards are provided to the players without any explanation or alternatively with simple explanations.

In one embodiment, at least one progressive award is associated with at least one suitable event which occurs in association with a player's gaming experience and is independent of any values of any primary game wagers placed. In another embodiment, a plurality of progressive awards are associated with a plurality of suitable events which occur in association with a player's gaming experience and is independent of any values of any primary game wagers placed. It should be appreciated that in these embodiments, the play of each game is dependent on a wager placed at one of the gaming devices in the gaming system but the tracked event is independent of the placed wager or the amount of the placed wager. In another embodiment, at least one progressive award is associated with at least one suitable event which occurs in association with a player's gaming experience and is based on one or more primary game wagers placed or the amounts of such primary game wagers placed. In different embodiments, which progressive award is associated with which suitable events which occur in association with a player's gaming experience is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

Figure 3:
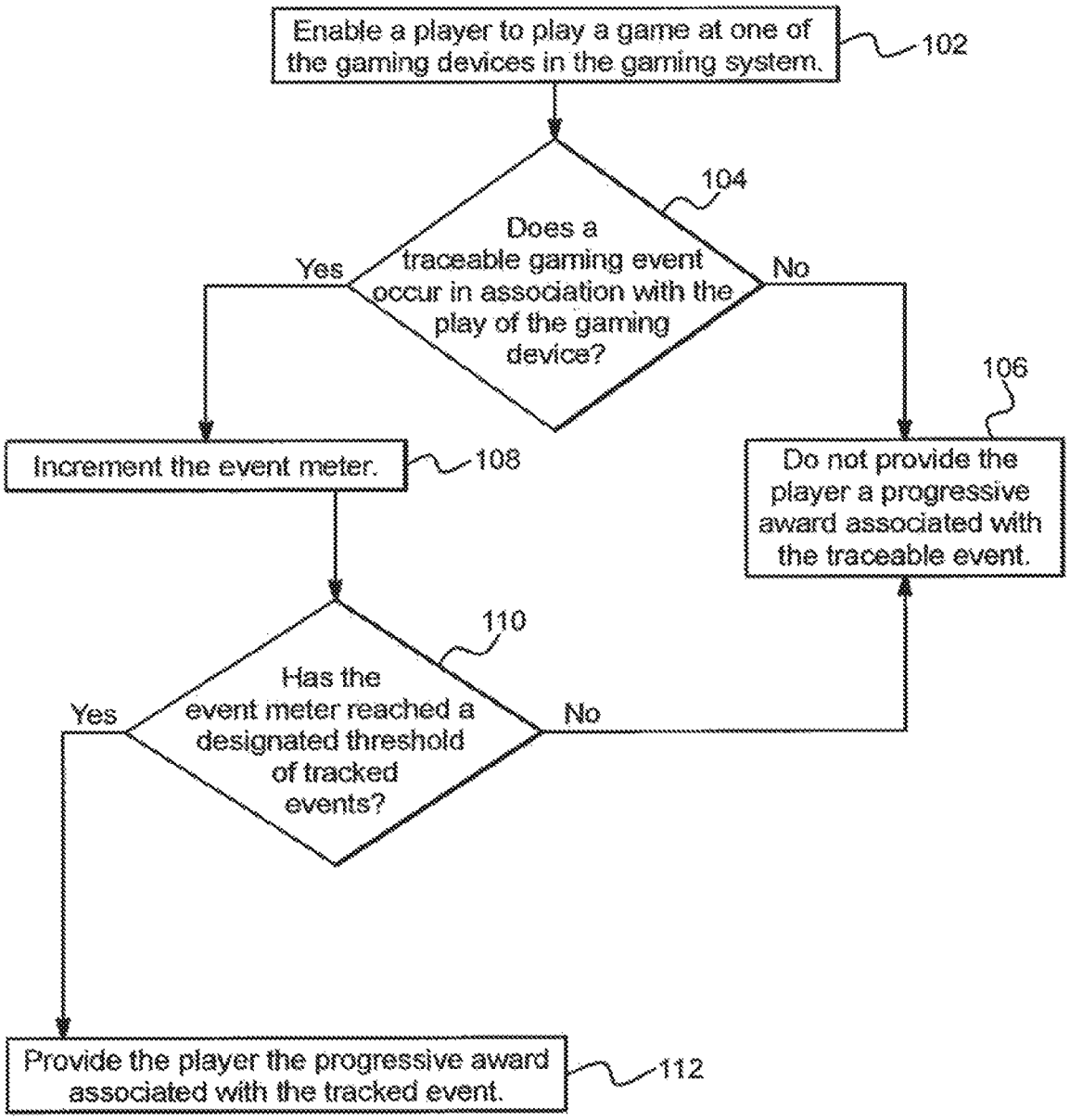
FIG. 3 is a flow-chart of one embodiment of the gaming system disclosed herein illustrating an accumulation of a tracked gaming event and a determination of whether to provide a player a progressive award associated with the tracked gaming event.

In operation of one embodiment of the gaming system disclosed herein, the central controller and/or gaming device processor enables a player to initiate game play, play a game or otherwise suitably interact with one of the gaming devices in the gaming system, as indicated in block 102 of FIG. 3. As indicated in diamond 104, the central controller determines if a tracked or traceable gaming event occurs in association with the initiation of game play, the play of a game or the otherwise suitable interaction with the gaming device. By implementing a central server, central controller or remote host to track such occurrences, the gaming system and method disclosed herein provides that a progressive award triggering condition may occur in association with any event or occurrence which is part of the player's gaming experience.

In one embodiment, each gaming device communicates data regarding each gaming event occurring at that gaming device to the central controller. In this embodiment, the central controller analyzes such data and tracks occurrences of one or more of the gaming events. In another embodiment, as described above, the central controller communicates to each eligible or participating gaming device data regarding which gaming events to track. In this embodiment, each gaming device communicates data to the central controller regarding such central controller tracked gaming events which occur at that gaming device.

In different embodiments, the tracked gaming events include, but are not limited to:

1. a deposit of an amount of funds at the gaming device;
2. an identification of a player (or a designated player) at the gaming device;
3. any player (or a designated player) placing a wager (regardless of the wager amount);
4. any player (or a designated player) placing a side-wager (regardless of the side-wager amount);
5. any player (or a designated player) wagering on a number of paylines;
6. any player (or a designated player) wagering on a designated payline;
7. any player (or a designated player) wagering on a number of ways to win;
8. any player (or a designated player) engaging an input device of the gaming device to cause a generation of an outcome;
9. an activation of a reel (or a designated reel):
10. an activation of a plurality of reels;
11. a generation of any outcome (or a designated outcome);
12. a generation of any outcome (or a designated outcome) associated with an award;
13. a generation of any outcome (or a designated outcome) associated with an award over a designated value;
14. a generation of an outcome (or a designated outcome) on a designated payline;
15. a generation of an outcome (or a designated outcome) in a scatter configuration;
16. a generation of a winning way to win (or a designated winning way to win):
17. a generation of a designated symbol or symbol combination;
18. a generation of a designated symbol or symbol combination on a designated payline;
19. a generation of a designated symbol or symbol combination in a scatter configuration;
20. an eligible gaming device providing any player (or a designated player) an award amount;
21. a triggering of a play of a secondary game;
22. an activation of a secondary display (such as the award generator of FIG. 1C);
23. an activation of a community award generator;
24. a generation of any outcome (or a designated outcome) in a secondary game;
25. any player (or a designated player) engaging an input device of the gaming device to make a selection in a game;

26. an amount of free spins provided;
27. an amount of time elapsed;
28. any event disclosed herein which is tracked for a group of gaming devices;
29. any event disclosed herein which includes a group of gaming devices working together for each occurrence of such tracked event;
30. any event disclosed herein which is tracked for a group of players;
31. any event disclosed herein which includes a group of players working together for each occurrence of such tracked event; and/or
32. any suitable event which occurs in association with a player's gaming experience.

It should be appreciated that in one embodiment, the tracked or traceable event may be any suitable event which occurs independent of any values of any primary game wagers placed and in association with: (a) one or more plays of one or more primary games at one or more of the gaming devices, (b) one or more plays of one or more secondary games at one or more of the gaming devices, or (c) one or more occurrences at one or more of the gaming devices which are independent of any primary or secondary games played. Accordingly, any action or decision the player makes in association with their gaming experience may lead to the player winning one or more progressive awards. Such a configuration provides that any suitable event, regardless of how often that event occurs, may be tracked and tied to the trigger of the gaming system providing one or more progressive awards to one or more players.

In one embodiment, the central controller tracks any event which is associated with a maintained progressive award. In an alternative embodiment, at least one progressive award is not initially associated with any gaming experience events. In different such embodiments, which gaming experience event is tracked for that progressive award is randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

It should be appreciated that if more than one gaming event can occur in association with a player's play of a game and if the number of occurred gaming events is based on one or more player actions, then the player's actions affect the player's probability of winning a progressive award. For example, if the tracked gaming event is the activation of a reel, then a player's decision to activate three reels (of a five reel gaming device) will result in the event meter associated with that gaming event to increment three times. In this example, such a decision by the player is associated with three chances or possibilities that the event meter will increment to a value equal to the threshold value and the player will win a progressive award. On other hand, if the player decides to activate five reels (of the five reel gaming device), then the event meter associated with that gaming event increments five times. In this example, the decision to activate five reels by the player is associated with five chances or possibilities that the event meter will increment to a value equal to the threshold value and the player will win a progressive award. Accordingly, different decisions within a play of a game result in different probabilities of a playing winning one or more progressive awards.

As indicated in block 106 of FIG. 3, if the central controller determines that no tracked event occurred in association with the initiation of game play, the play of a game or the otherwise suitable interaction with the gaming device, the gaming system does not provide the player any progressive award associated with the tracked event. In this case, the central controller and/or gaming device processor enables a play of the game to proceed at that gaming device in any suitable manner.

On the other hand, as indicated in block 108, if the central controller determines that a tracked event occurred in association with the initiation of game play, the play of a game or the otherwise suitable interaction with the gaming device, the central controller increments an event meter associated with the tracked event. After incrementing the event meter associated with the occurred tracked event, the central controller determines if the incremented event meter has reached a threshold of occurrences of tracked events as indicated in diamond 110.

In one embodiment, one or more gaming events are each associated with a separate range of quantities for that gaming event. In this embodiment, depending on the type of gaming event tracked, the central server selects a quantity within the range of quantities to function as the threshold quantity. It should be appreciated that different gaming events are associated with different ranges based, at least in part, on the frequency which the gaming events occur. For example, a relatively frequent gaming event, such as a player placing a wager on a designated payline at a gaming device is associated with a relatively large range of quantities (e.g., 1,000 to 10,000) and a relatively infrequent gaming event, such as a triggering of a secondary game at a gaming device is associated with a relatively small range of quantities (e.g., 100 to 1000). By setting different ranges of quantities of gaming events which must be accumulated to provide different progressive awards, the gaming system provides that different progressive awards are associated with different probabilities of being provided to players.

In one embodiment, the threshold of occurrences of a tracked gaming events is determined by a gaming system operator. In different embodiments, the threshold of occurrences of a tracked events is predetermined, randomly determined, determined based on the player's status (such as determined through a player tracking system), determined based on a generated symbol or symbol combination, determined based on a random determination by the central controller, determined based on a random determination at the gaming machine, determined based on a weighted parameter, determined based on a determined subset range, determined based on one or more side wagers placed, determined based on the player's primary game wager, determined based on time (such as the time of day), determined based on an amount of coin-in accumulated in one or more pools or determined based on any other suitable method or criteria.

As indicated in block 106 of FIG. 3, if the central controller determines that the incremented event meter has not reached the threshold of occurrences of tracked events, the gaming system does not provide the player a progressive award associated with the tracked gaming event. In this case, the central controller and/or gaming device processor enables a play of the game to proceed at that gaming device in any suitable manner.

If the central controller determines that the incremented event meter has reached the threshold of occurrence of tracked events, as indicated in block 112, the gaming system provides a player the progressive award associated with the tracked gaming event. After the progressive award is provided to a player, as described above, the value of this progressive award is reset to a default value and starts incrementing from the default progressive award level.

In one embodiment, the progressive award associated with the tracked gaming event is provided to the player who caused the incremented event meter to increment to its respective threshold. In another embodiment, the progressive award associated with the tracked gaming event is provided to a player different than the player who caused the incremented event meter to increment to its respective threshold. In different embodiments, the player whom is provided the progressive award associated with the tracked gaming event is determined based on a determined weighting associated with past play or past wagering activity, predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the full value of the progressive award associated with the tracked event is provided to a player. In another embodiment, part, but not all of the value of the progressive award associated with the tracked event is provided to a player. In one such embodiment, to account for different players wagering different amounts (and having equal or substantially equal probabilities of winning a progressive award), the amount of the progressive award associated with the tracked event which is provided to a player is based on the amount of the player's wager. Such a configuration provides that different players wagering at different wager levels are provided different proportions of a progressive award which is determined to be provided based on a designated quantity of occurrences of any identifiable and traceable event at any of the linked gaming devices in the gaming system. In different embodiments, the amount, part or proportion of the progressive award associated with the tracked event which is provided to a player is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on time (such as the time of day), determined based on an amount of coin-in accumulated in one or more pools or determined based on any other suitable method or criteria.

In another embodiment, a non-progressive award is provided to the player if the central controller determines that the incremented event meter has reached the threshold of occurrence of tracked events. In a different embodiment, the non-progressive award is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on time (such as the time of day), determined based on an amount of coin-in accumulated in one or more pools or determined based on any other suitable method or criteria. In different embodiments, the non-progressive award may be any suitable award such as, but not limited to, a value, one or more multipliers, one or more modifiers, one or more anti-terminators, one or more offers to accept or reject, one or more plays of one or more games utilizing an enhanced paytable, one or more additional player picks in a selection game, one or more activations of an award generator, one or more retriggers, one or more nudges, a number of free games, free spins or free activations, or a replay of one or more previous games.

Figure 4A:
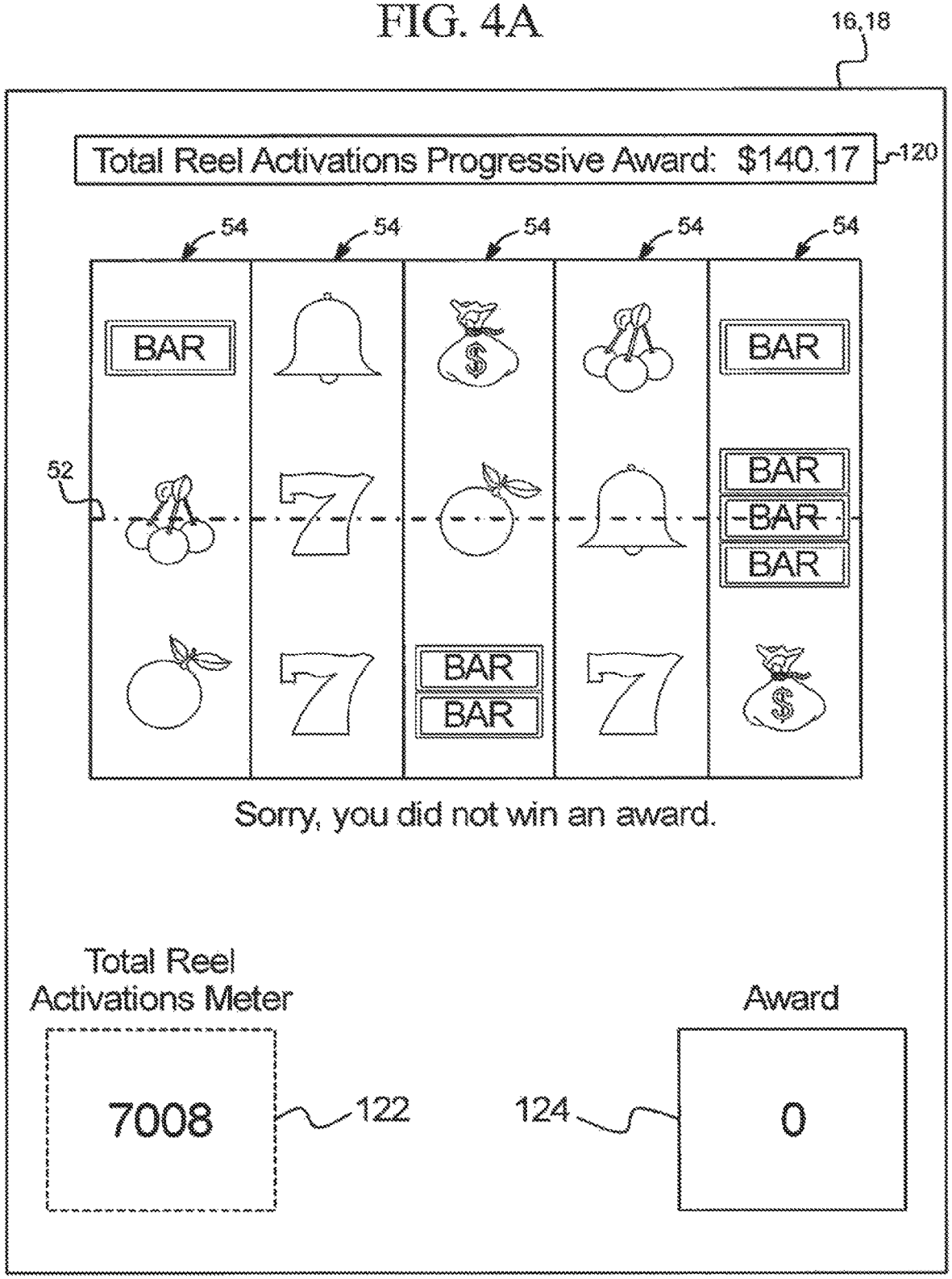
FIGS. 4A, 4B and 4C are front-side perspective views of one embodiment of a gaming device of the gaming system disclosed herein illustrating a progressive award associated with a total number of reel activations.

One example embodiment of the gaming system disclosed herein includes a progressive award associated with a quantity of reel activations. As seen in FIG. 4A, a total reel activations progressive award 120 is currently valued at $140.17. The total reel activations progressive award is associated with a threshold of 7009 occurrences of the tracked gaming event. In this example embodiment, for each activation of the reels at one or more gaming devices in the gaming system, the central controller and/or gaming device processor increments a total reel activations meter 122 to account for such a reel activation. The central controller and/or gaming device processor compares the incremented total reel activations meter to a designated threshold or quantity of total reel activations to determine whether to provide the progressive award associated with the quantity of reel activations. The current value of the gaming event meter may or may not be displayed to the player.

FIG. 4A illustrates that the gaming device generated a plurality of symbols and the generated symbol combinations are not associated with any awards (according to an applicable paytable). Accordingly, an award meter 124 displays an award of zero provided to the player. FIG. 4A also illustrates that the total reel activations meter 122 was incremented to 7008 (which was not equal to the designated threshold or quantity of total reel activations) and thus the total reel activations progressive award was not provided to the player. Appropriate messages such as "SORRY, YOU DID NOT WIN AN AWARD" may be provided to the player visually, or through suitable audio or audiovisual displays.

Figure 4B:
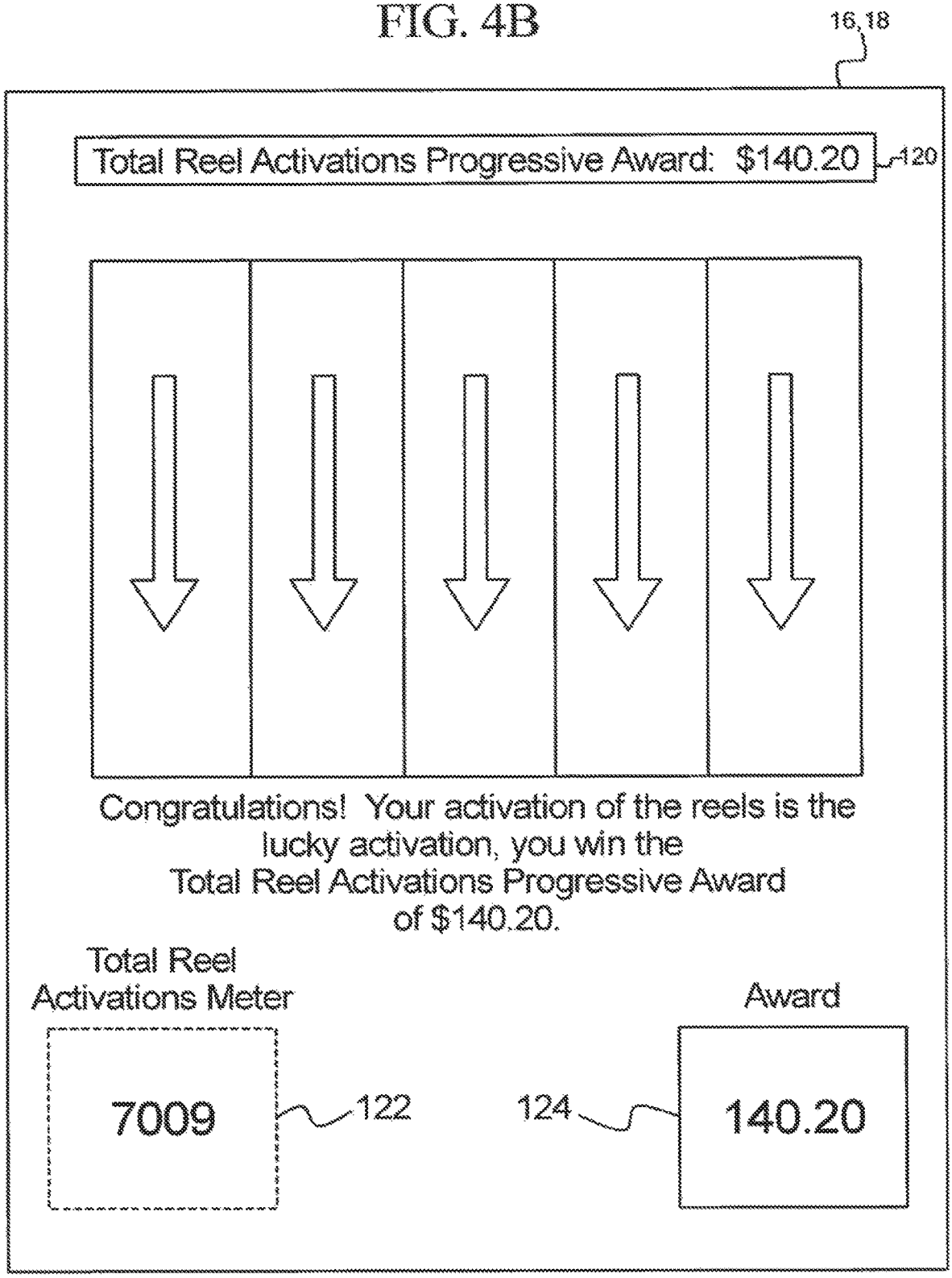

As illustrated in FIG. 4B, the player places a wager at the gaming device and, based on at least part of the wager placed, the total reel activations progressive award increments to $140.20. Additionally, upon a suitable input by the player, the central controller and/or gaming device processor activates the reels to spin. Such activation of the reels is tracked by the central controller which increments the total reel activations meter 122 to 7009. In this example, upon a determination that the total reel activations meter is incremented to a value which equals (or substantially equals) the designated threshold or quantity of total reel activations, the total reel activations progressive award is provided to the player. The award meter 124 displays an award of $140.20 provided to the player. It should be appreciated that the determination to provide this progressive award to the player is independent of any symbols or symbol combinations generated in the play of the game. It should be further appreciated that in this illustrated embodiment, the determination to provide this progressive award to the player is independent of the value or amount of the progressive award and any primary game wagers placed. Appropriate messages such as "CONGRATULATIONS" and "YOUR ACTIVATION OF THE REELS IS THE LUCKY ACTIVATION, YOU WIN THE TOTAL REEL ACTIVATIONS PRO- GRESSIVE AWARD OF $140.20" may be provided to the player visually, or through suitable audio or audiovisual displays.

Figure 4C:
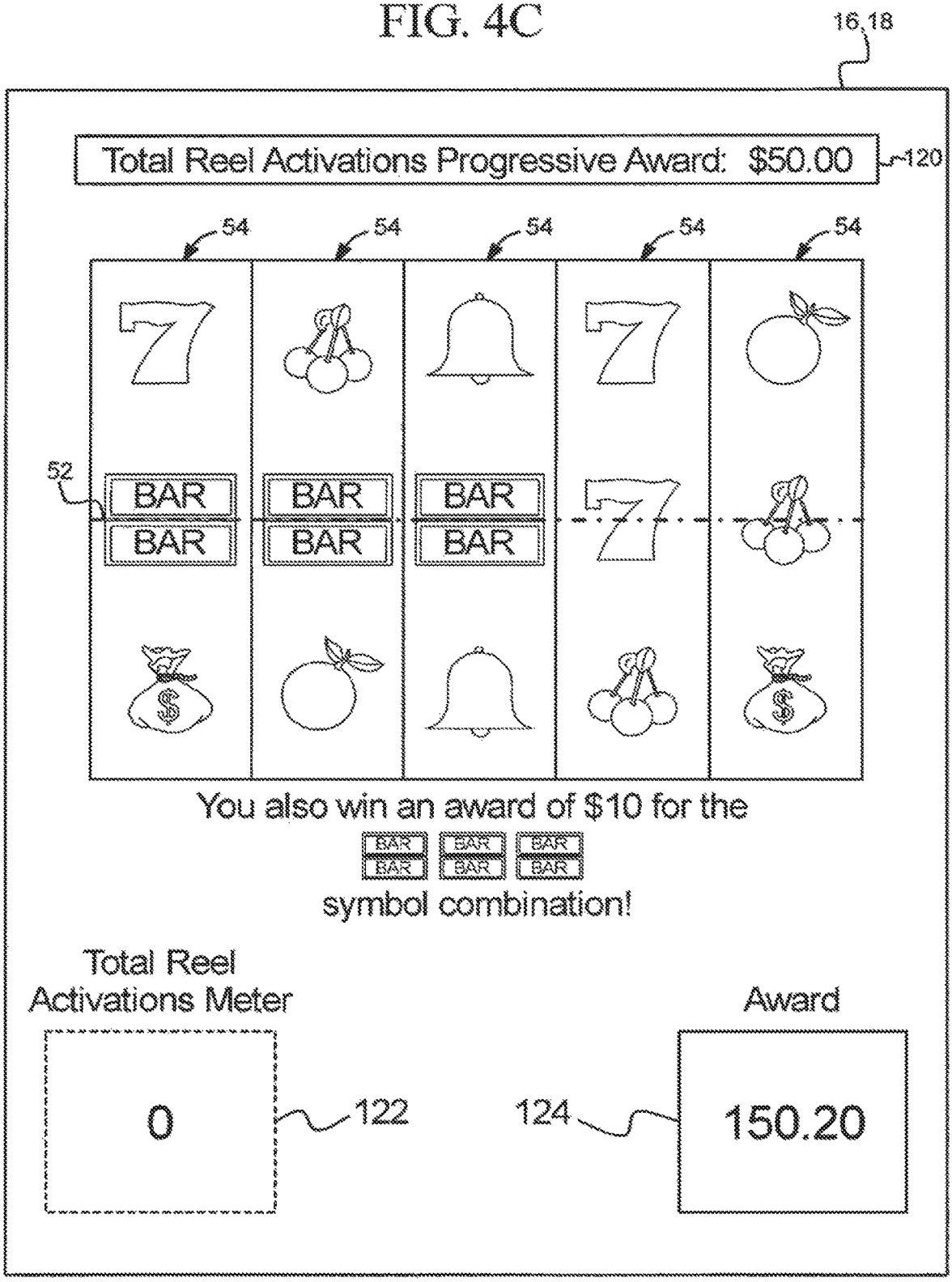

As seen in FIG. 4C, after providing the player the progressive award associated with the quantity of reel activations reaching a designated threshold, the central controller and/or gaming device processor resets the total reel activations progressive award 120 to $50.00. The central controller and/or gaming device processor also resets the total reel activations meter 122 to zero to account for the provided total reel activations progressive award.

FIG. 4C further illustrates that the gaming device generated a plurality of symbols and the generated symbol combination of double bar-double bar-double bar is associated with an award of $10 (according to an applicable paytable). This symbol combination award is provided to the player and the award meter adds the symbol combination award of $10 to the total reel activations progressive award of $140.20 to display a total award of $150.20. Appropriate messages such as "YOU ALSO WIN AN AWARD OF $10 FOR THE DOUBLE BAR-DOUBLE BAR-DOUBLE BAR SYMBOL COMBINATION" may be provided to the player visually, or through suitable audio or audiovisual displays.

In another embodiment, at least one of the progressive awards in the gaming system is associated with an independent award generator, such as the award wheel 60 illustrated in FIG. 1C. In this embodiment, if the central controller and/or gaming device processor determines to activate the award generator, then utilizing an appropriate indicator 66, the activated award generator indicates one of the awards associated with the award generator. The indicated award is provided to the player. In addition to providing the player any award generated by the award generator, the central server tracks the occurrence of such a generation and increments an award generator activation meter to account for this activation. The central controller proceeds with comparing the incremented award generator activation meter to a designated quantity or threshold of award generator activations to determine to provide the progressive award associated with the award generator to a player.

In one embodiment, at least one progressive award is associated with a plurality of different traceable or tracked events which occur in association with the player's gaming experience. In one such embodiment, upon the central controller determining that one of the different tracked events has occurred a designated quantity of times in association with the gaming devices in the gaming system, the central server provides the progressive award associated with this tracked event to a player (regardless of the other tracked event(s) associated with the progressive award not occurring a designated quantity of times). For example, if a progressive award is associated with (1) a quantity of seven symbols generated and (2) a quantity of generated winning symbol combinations and a threshold quantity of tracked generated seven symbols is reached, then the progressive award is provided to the player (even though the threshold quantity of tracked generated winning symbol combinations is not reached).

In another such embodiment, each of a plurality of different tracked events associated with a progressive award must occur a designated quantity of times in association with the gaming devices in the gaming system for the central server to provide the progressive award associated with these tracked events to a player. For example, if a progressive award is associated with a first type of tracked event, such as the generation of a seven symbol, and the progressive award is also associated with a second type of tracked event, such as the generation of a winning symbols combination that is associated with an award over one-hundred credits, then both types of tracked events must each occur their respective designated quantity of times for the central controller to provide the progressive award to a player.

In another embodiment, a plurality of progressive awards are associated with at least one tracked event which occurs in association with the player's gaming experience. In this embodiment, upon the central controller determining that the tracked gaming event has occurred a designated quantity of times in association with the participating gaming devices in the gaming system, the central controller provides the plurality of progressive awards associated with this tracked event to one or more players. In one such embodiment, the central controller provides the plurality of progressive awards to one player. In another such embodiment, the central controller provides the plurality of progressive awards to a plurality of players, wherein which players are provided which progressive awards is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, different progressive awards are associated with different tracked events which occur in association with the player's gaming experience. For example, as seen in FIG. 5, a gaming device in the gaming system displays that one progressive award 140 is associated with an accumulation of a designated quantity of total winning symbol combinations and another progressive award 142 is associated with an accumulation of a designated quantity of triggered bonus games. As further seen in FIG. 5, one of the progressive awards 144 of the gaming system is associated with an accumulation of a designated quantity of generated seven symbols and another progressive award 146 is associated with an accumulation of a designated quantity of wagered on paylines.

In this embodiment, due to the different progressive awards being triggered at different times and based on different accumulations of gaming events, a plurality of progressive awards with different default values may overlap in value. Thus, even though one of the progressive awards associated with one of the tracked events is provided to a player, the remaining non-provided progressive awards associated with different tracked events continue to increment to greater and greater amounts until such progressive awards are provided to players. Thus, for every play of the game by the player, there are a number of award opportunities available and because of the cyclical nature of the progressives there is a high probability that one will be a desirable prize to play for, thus eliminating jackpot fatigue. In other words, in the gaming system disclosed herein, there is always the chance a player can receive one or more progressives for each game played. Accordingly, it is possible for the player to win a plurality of different types of progressive awards at once based on a single game play.

In another such embodiment, in combination with one or more of the other factors described herein, at least one of the progressive awards in the gaming system is associated with an amount of elapsed time. In this embodiment, the central server randomly selects a point in time from a predetermined time period. At the randomly selected point in time, the central server provides a progressive award to a player at a gaming device where a suitable gaming event occurs. In one such embodiment, the first gaming device where the suitable gaming event occurs is provided this progressive award.

In another embodiment, the gaming system is operable to group certain players together into different player groups. In one such embodiment, which player group a player is placed in or otherwise associated with is based on the player tracking status or ranking (obtained via a player tracking system) associated with that player. In another such embodiment, which player group a player is placed in or otherwise associated with is based on one or more aspects of the player's wagering history, such as the player's last wager or the player's average wager. In different embodiments, which player group a player is placed in or otherwise associated with is based on the type of games the player plays, randomly determined, predetermined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on the amount of coin-in accumulated in one or more pools, or determined based on any other suitable method or criteria.

In these embodiments, each player group is associated with a separate progressive award and a separate threshold of events which must occur (and be tracked by the central server accordingly) to trigger a gaming device providing that progressive award to a player. In this embodiment, upon the central server determining that the quantity of tracked occurred events has reached a threshold (i.e., a triggering event has occurred) for that group of players, the gaming system provides the progressive award associated with the player group to one of the players in the player group that is playing one of the gaming devices in the gaming system.

In one such example, a first progressive award is provided to a gold level player at one of the gaming devices in the gaming system when a first number or quantity of bonus games have been triggered at gaming devices played by gold level players. In this example, a second progressive award is provided to one of the platinum level players at one of the gaming devices in the gaming system when a second, lower number or quantity of bonus games have been triggered at gaming devices played by platinum level players. Accordingly, in this example, a first group of players (i.e., a number of platinum level players) have a greater relative probability of winning a progressive award (relative to the number of games played by the players in that group) than a second group of players (i.e., an equal number of gold level players) due to the lower threshold of traceable events. Such a configuration provides that different players with different characteristics may be segmented and providing increased probabilities of winning progressive awards based on these characteristics.

In another embodiment, different player groups are associated with the same gaming event, the same progressive award and different thresholds of occurrences of that gaming event occurring. In this embodiment, the central server provides the progressive award to one of the players of a first player group if the occurrences of the gaming event tracked in association with the first player group reaches a first threshold. In this embodiment, the central controller provides the progressive award to one of the players of a second player group if the occurrences of the gaming event tracking in association with the second player group reaches a second, different threshold. This embodiment provides that different groups of players are associated with different thresholds of occurrences of the same tracked event, wherein the progressive award is provided to whichever respective threshold of occurrences is reached first.

In another embodiment, a plurality of different player groups are each associated with one progressive award but the different player groups are each associated with a different threshold of tracked occurrences of different gaming events. In this embodiment, the central server provides the progressive award to one of the players of a first player group if the gaming event associated with the first player group reaches a first threshold. In this embodiment, the central controller provides the progressive award to one of the players of a second player group if the gaming event associated with the second player group reaches a second, different threshold. Such a configuration provides that different groups of players may compete for a common progressive award based on the tracked occurrences of different gaming events.

In another embodiment, if a suitable traceable gaming event occurs at or otherwise in association with a gaming device, prior to tracking such an occurrence, the central controller determines whether that gaming device is associated with the tracked event. That is, the central server determines whether the gaming device wherein a tracked event occurs is participating in the tracking of that event. In different embodiments, the determination of whether a gaming device is participating in the tracking of a gaming event is randomly determined, predetermined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on the amount of coin-in accumulated in one or more pools, or determined based on any other suitable method or criteria.

In another embodiment, the determination of whether a gaming device is participating in the tracking of a gaming event is based on the active or inactive status of the gaming device. In this embodiment, each gaming machine has its own entry defining its state as either active or inactive and also defining the values of the wagers from that gaming machine. In one embodiment, active status means that the gaming machine is being actively played by a player and enrolled/inactive status means that the gaming machine is not being actively played by a player. The active status requirements can be based on any suitable number of satisfied criteria or defined in any suitable manner by the implementer of the gaming system. For instance, a play of or wager on the primary game of the gaming machine within a predetermined period of time may be part of the determination of whether that gaming machine is in the active status. Other factors such as: (a) the amount of time between each play of or wager on the primary game of the gaming machine; (b) the amount being wagered on the primary game(s); and (c) the number of plays within a period of time, may also or alternatively be part of the determination of whether a gaming machine is in the active status; (d) the existence of credits on the gaming device may also or alternatively be part of the determination of whether a gaming machine is in the active status. On the other hand, inactive status means that the gaming machine is one of the gaming machines in the gaming system, but is not in the active status (i.e., not being actively played by a player according to one or more of the predetermined criteria).

In another embodiment, a triggering event occurs and one of the progressive awards is provided to a player (or at least one gaming device in the gaming system is provided a chance at winning one of the progressive awards in a secondary game) based on a predefined variable reaching a defined parameter threshold in combination with one or more of the other factors described herein. For example, a progressive award triggering event occurs when the 500,000$^{th}$ player has played a gaming machine associated with one of the progressive awards (ascertained from a player tracking system). In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In another embodiment, a triggering event occurs and one of the progressive awards is provided to a player (or at least one gaming device in the gaming system is provided a chance at winning one of the progressive awards in a secondary game) based on time in combination with one or more of the other factors described herein. In this embodiment, a time is set for when a progressive triggering event will occur. In one embodiment, such a set time is based on historic data. For example, if previous progressives have reached $5 million after approximately sixty-seven days, a progressive award may be set to trigger sixty-seven days from when the progressive award is reset. In one embodiment, a suitable algorithm is implemented to determine the player who wagered at or closest to this time with tie-breaking based on any number of factors (e.g., player tracking history, amount of or recent wagers placed). In this embodiment, the progressive award is provided to the player who the algorithm determined wagered closest to when the progressive award is triggered. In another embodiment, one of the player who wagered during a designated time period is randomly selected and the progressive award is provided to the selected player.

In another embodiment, a triggering event occurs and one of the progressive awards is provided to a player (or at least one gaming device in the gaming system is provided a chance at winning one of the progressive awards in a secondary game) based upon gaming system operator defined player eligibility parameters stored on a player tracking system (such as via a player tracking card or other suitable manner) in combination with one or more of the other factors described herein. For example, a gaming system operator may choose to only enable players of the highest player tracking status to be eligible for a progressive award. In this embodiment, the parameters for eligibility are defined by the gaming system operator based on any suitable criterion. In one embodiment, the central controller/gaming device processor recognizes the player's identification (via the player tracking system) when the player inserts their player tracking card in the gaming machine. The central server/gaming device processor determines the player tracking level of the player and if the current player tracking level defined by the gaming system operator is eligible for the progressive award. In one embodiment, the gaming system operator defines minimum bet levels required for the progressive award based on the player's card level. In this embodiment, different bet amounts are required to be eligible to receive different progressive award levels. In another embodiment, as described above, different side bets or side-wager amounts are required to be eligible to receive different progressive award levels. Once the central controller/gaming device processor determines which players are eligible, any suitable method for awarding the progressive award may be employed.

Another embodiment for determining the winner of one or more of the progressive awards (or for determining if at least one gaming device in the gaming system is provided a chance at winning one of the progressive awards in the secondary game) includes, in combination with one or more of the other factors described herein, a system determination, wherein the progressive award is provided due to a random selection by the central controller. In one embodiment, the central controller tracks all active gaming machines and the wagers they placed. Each gaming machine has its own entry defining its state as either active or inactive and also defining the values of the wagers from that gaming machine. Based on the gaming machine's state as well as one or more wager pools associated with the gaming machine, the central controller determines which of these gaming machines receives the progressive award. The player who consistently places a higher wager is more likely to receive one of the progressive awards than a player who consistently places a minimum wager.

In another embodiment, a progressive award is provided (or at least one gaming device in the gaming system is provided a chance at winning one of the progressive awards in the secondary game), in combination with one or more of the other factors described herein, by determining if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, that particular gaming machine is provided all or part of one of the progressive awards.

Information Provided to Player

As indicated above, the progressive awards may be provided to the players of the gaming machines with or without explanation or information provided to the player, or alternatively information can be displayed to the player. In one embodiment, suitable information about the progressive awards can be provided to the players through one or more displays on the gaming machines or additional information displays positioned near the gaming machines, such as above a bank of system gaming machines.

This information can be used to entertain the player or inform the player that a progressive award triggering event has occurred or will occur. Examples of such information are:

(1) that a progressive award triggering event has occurred;
(2) that a progressive award triggering event will shortly occur (i.e., foreshadowing the providing of a progressive award);
(3) that one or more progressive awards have been provided to one or more players of the system gaming machines;
(4) which gaming machines have won the progressive awards;
(5) the amount of the progressive awards won;

(6) the highest progressive award won;
(7) the lowest progressive award won;
(8) the average progressive award won;
(9) number of games played/total time since the last progressive award was won;
(10) the average time between progressives being hit;
(11) the number of progressive awards won in a designated time period; and
(12) the amount of the progressive awards that can be won;

It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:
a processor; and
a memory device which stores a plurality of instructions, which when executed by the processor, cause the processor to:
randomly determine a plurality of symbols,
cause a display device to display the randomly determined plurality of symbols at a plurality of symbol display positions,
for each of a plurality of different paylines, responsive to one or more of the symbols displayed at the symbol display positions intersecting that payline forming any one of a plurality of different winning symbol combinations:
designate that payline as a winning payline, and
determine an award associated with the formed winning symbol combination,
responsive to a first quantity of paylines being designated as winning paylines, cause the display device to display a first total award of a sum of the determined awards associated with the formed winning symbol combinations, and
responsive to a second, greater quantity of paylines being designated as winning paylines and the second quantity of paylines exceeding a threshold, cause the display device to display a second, different total award of a first progressive award and the sum of the determined awards associated with the formed winning symbol combinations, wherein the first progressive award is awarded based on the second quantity of paylines exceeding the threshold and is distinct from the determined awards associated with the formed winning symbol combinations.

2. The gaming system of claim 1, wherein when executed by the processor responsive to a third quantity of paylines being designated as winning paylines, the instructions cause the processor to cause the display device to display a third total award of a second progressive award and the sum of the determined awards associated with the formed winning symbol combinations, wherein the third quantity of paylines is greater than the second quantity of paylines and the second progressive award is greater than the first progressive award.

3. The gaming system of claim 2, wherein when executed by the processor responsive to a fourth quantity of paylines being designated as winning paylines, the instructions cause the processor to cause the display device to display a fourth total award of a third progressive award and the sum of the determined awards associated with the formed winning symbol combinations, wherein the fourth quantity of paylines is greater than the third quantity of paylines and the third progressive award is greater than the second progressive award.

4. The gaming system of claim 1, wherein different quantities of paylines designated as winning paylines are associated with different progressive awards.

5. The gaming system of claim 1, wherein the paylines designated as winning paylines comprise wagered on paylines.

6. The gaming system of claim 1, wherein the designation of paylines as winning paylines occurs in association with a plurality of random determinations of a plurality of symbols.

7. The gaming system of claim 1, wherein the plurality of different winning symbol combinations comprises a subset of each of the winning symbol combinations.

8. The gaming system of claim 1, further comprising an acceptor, wherein when executed by the processor, the plurality of instructions cause the processor to: responsive to a physical item being received via the acceptor, establish a credit balance based, at least in part, on a monetary value associated with the received physical item, and responsive to a cashout input being received, cause an initiation of any payout associated with the credit balance.

9. The gaming system of claim 1, wherein the display device comprises part of a handheld mobile device in communication, via a wireless network, with the processor.

10. A method of operating a gaming system, the method comprising:
randomly determining, by a processor, a plurality of symbols,
displaying, by a display device, the randomly determined plurality of symbols at a plurality of symbol display positions,
for each of a plurality of different paylines, responsive to one or more of the symbols displayed at the symbol display positions intersecting that payline forming any one of a plurality of different winning symbol combinations:
designating, by the processor, that payline as a winning payline, and
determining, by the processor, an award associated with the formed winning symbol combination,
responsive to a first quantity of paylines being designated as winning paylines, displaying, by the display device, a first total award of a sum of the determined awards associated with the formed winning symbol combinations, and
responsive to a second, greater quantity of paylines being designated as winning paylines and the second quantity of paylines exceeding a threshold, displaying, by the display device, a second, different total award of a first progressive award and the sum of the determined awards associated with the formed winning symbol combinations, wherein the first progressive award is awarded based on the second quantity of paylines exceeding the threshold and is distinct from the determined awards associated with the formed winning symbol combinations.

11. The method of claim 10, further comprising, responsive to a third quantity of paylines being designated as winning paylines, displaying, by the display device, a third total award of a second progressive award and the sum of the determined awards associated with the formed winning symbol combinations, wherein the third quantity of paylines is greater than the second quantity of paylines and the second progressive award is greater than the first progressive award.

12. The method of claim 11, further comprising, responsive to a fourth quantity of paylines being designated as winning paylines, displaying, by the display device, a fourth total award of a third progressive award and the sum of the determined awards associated with the formed winning symbol combinations, wherein the fourth quantity of paylines is greater than the third quantity of paylines and the third progressive award is greater than the second progressive award.

13. The method of claim 10, wherein different quantities of paylines designated as winning paylines are associated with different progressive awards.

14. The method of claim 10, wherein the paylines designated as winning paylines comprise wagered on paylines.

15. The method of claim 10, wherein the designation of paylines as winning paylines occurs in association with a plurality of random determinations of a plurality of symbols.

16. The method of claim 10, wherein the plurality of different winning symbol combinations comprises a subset of each of the winning symbol combinations.

17. The method of claim 10, which is provided through a wireless data network.

* * * * *